US011180962B2

(12) United States Patent
Dorin

(10) Patent No.: US 11,180,962 B2
(45) Date of Patent: Nov. 23, 2021

(54) DUAL ROD DIRECTIONAL DRILLING SYSTEM

(71) Applicant: Vermeer Manufacturing Company, Pella, IA (US)

(72) Inventor: Tyler J. Dorin, Pleasant Hill, IA (US)

(73) Assignee: Vermeer Manufacturing Company, Pella, IA (US)

( * ) Notice: Subject to any disclaimer, the term of this patent is extended or adjusted under 35 U.S.C. 154(b) by 160 days.

(21) Appl. No.: 16/654,710

(22) Filed: Oct. 16, 2019

(65) Prior Publication Data

US 2020/0165880 A1 May 28, 2020

Related U.S. Application Data

(60) Provisional application No. 62/771,383, filed on Nov. 26, 2018, provisional application No. 62/771,376, filed on Nov. 26, 2018.

(51) Int. Cl.

| | |
|---|---|
| ***E21B 7/04*** | (2006.01) |
| ***E21B 7/06*** | (2006.01) |
| ***E21B 17/046*** | (2006.01) |

(52) U.S. Cl.

CPC ..... *E21B 17/046* (2013.01); *E21B 7/046* (2013.01); *E21B 7/062* (2013.01)

(58) Field of Classification Search

CPC ..... E21B 7/046; E21B 7/062; E21B 17/046
See application file for complete search history.

(56) References Cited

U.S. PATENT DOCUMENTS

| | | | |
|---|---|---|---|
| 1,274,254 | A | 7/1918 | Fleek |
| 2,069,603 | A | 2/1937 | Earley |
| 2,760,358 | A | 8/1956 | Helm et al. |
| 3,142,972 | A | 8/1964 | Spaulding, Jr. |
| 3,260,541 | A | 7/1966 | Sadler et al. |
| 3,940,946 | A | 3/1976 | Andersen |
| 4,378,057 | A | 3/1983 | O'Connell |
| 4,622,022 | A | 11/1986 | Diffenderfer et al. |
| 4,732,223 | A | 3/1988 | Schoeffler et al. |

(Continued)

FOREIGN PATENT DOCUMENTS

| | | | |
|---|---|---|---|
| CN | 102235433 | A | 11/2011 |
| CN | 202370449 | U | 8/2012 |

(Continued)

OTHER PUBLICATIONS

European Search Report for Related Application No. 18170061.8 dated Feb. 2, 2019 (8 pages).

(Continued)

*Primary Examiner* — Giovanna Wright
(74) *Attorney, Agent, or Firm* — Michael Best and Friedrich LLP

(57) ABSTRACT

A horizontal directional drilling system includes a drill head that includes a drive coupling with a central bore that is a through bore. The drill head includes a drive shaft that has an enlarged portion at a downhole end that defines a centroid positioned within the central bore of the drive coupling. The drive shaft includes a drive shaft axis that is misaligned and intersects with an end casing axis of an end casing at a balance point of the drill head. The centroid of the drive shaft is positioned to be coincident with the balance point of the drill head.

19 Claims, 15 Drawing Sheets

(56) References Cited

U.S. PATENT DOCUMENTS

| | | | |
|---|---|---|---|
| 4,772,246 | A | 9/1988 | Wenzel |
| 4,824,418 | A | 4/1989 | Taubert |
| 4,828,050 | A | 5/1989 | Hashimoto |
| 4,904,228 | A | 2/1990 | Frear et al. |
| 5,048,621 | A | 9/1991 | Bailey et al. |
| 5,048,622 | A | 9/1991 | Ide |
| 5,288,271 | A | 2/1994 | Nelson et al. |
| 5,408,905 | A | 4/1995 | Mikic et al. |
| 5,484,029 | A | 1/1996 | Eddison |
| 5,490,569 | A | 2/1996 | Brotherton et al. |
| 5,671,816 | A | 9/1997 | Tibbitts |
| 6,173,794 | B1 | 1/2001 | von Gynz-Rekowski et al. |
| 6,203,435 | B1 | 3/2001 | Falgout, Sr. |
| 6,607,044 | B1 | 8/2003 | Eppink et al. |
| RE38,418 | E | 2/2004 | Deken et al. |
| 7,004,843 | B1 | 2/2006 | Kerstetter |
| 7,195,083 | B2 | 3/2007 | Eppink et al. |
| 7,207,398 | B2 | 4/2007 | Runia et al. |
| 7,216,724 | B2 | 5/2007 | Self et al. |
| 7,469,524 | B2 | 12/2008 | Rieck et al. |
| 7,624,819 | B1 | 12/2009 | LeBlanc et al. |
| 7,694,753 | B2 | 4/2010 | Carlson et al. |
| 7,770,659 | B2 | 8/2010 | Uelhoff et al. |
| 8,033,917 | B2 | 10/2011 | Prill et al. |
| 8,033,920 | B1 | 10/2011 | Benson |
| 8,062,140 | B2 | 11/2011 | Wall et al. |
| 8,157,025 | B2 | 4/2012 | Johnson |
| 8,201,644 | B2 | 6/2012 | Hall et al. |
| 8,342,970 | B2 | 1/2013 | Altimas et al. |
| 8,534,388 | B2 | 9/2013 | Hall et al. |
| 8,650,992 | B2 | 2/2014 | Neitzell et al. |
| 8,721,182 | B2 | 5/2014 | Cioceanu |
| 8,900,062 | B2 | 12/2014 | Nicol-Seto |
| 8,915,788 | B2 | 12/2014 | Foote et al. |
| 9,347,269 | B2 | 5/2016 | Marchand et al. |
| 9,366,087 | B2 | 6/2016 | Sugiura et al. |
| 9,382,950 | B2 | 7/2016 | Pheasey et al. |
| 9,470,042 | B2 | 10/2016 | Snyder et al. |
| 9,915,106 | B2 | 3/2018 | Underwood et al. |
| 10,053,914 | B2 | 8/2018 | Lehr et al. |
| 10,711,520 | B2 * | 7/2020 | Langenfeld ..... E21B 17/18 |
| 2007/0054743 | A1 | 3/2007 | Pleyer |
| 2007/0176034 | A1 | 8/2007 | Roozeboom |
| 2007/0272444 | A1 | 11/2007 | Carlson et al. |
| 2008/0083077 | A1 | 4/2008 | Alexander et al. |
| 2009/0275415 | A1 | 11/2009 | Prill et al. |
| 2009/0298597 | A1 | 12/2009 | Wall et al. |
| 2010/0313692 | A1 | 12/2010 | Wenzel |
| 2014/0027184 | A1 | 1/2014 | Slaughter, Jr. et al. |
| 2014/0182941 | A1 | 7/2014 | Oppelaar |
| 2014/0224545 | A1 | 8/2014 | Nicol-Seto |
| 2014/0305709 | A1 | 10/2014 | Slaughter, Jr. et al. |
| 2015/0167399 | A1 | 6/2015 | Kuhn et al. |
| 2015/0233192 | A1 | 8/2015 | Slaughter, Jr. et al. |
| 2015/0308193 | A1 | 10/2015 | Schurmann |
| 2016/0245025 | A1 * | 8/2016 | Slaughter, Jr. ..... E21B 7/046 |
| 2017/0219014 | A1 * | 8/2017 | Strattan ..... F16D 1/101 |
| 2018/0073301 | A1 | 3/2018 | Russell et al. |
| 2018/0119494 | A1 | 5/2018 | Slaughter, Jr. |
| 2018/0313157 | A1 | 11/2018 | Langenfeld et al. |

FOREIGN PATENT DOCUMENTS

| | | | |
|---|---|---|---|
| CN | 203939454 | U | 11/2014 |
| CN | 104499957 | A | 4/2015 |
| CN | 104870739 | A | 8/2015 |
| CN | 204754796 | U | 11/2015 |
| DE | 1909931 | A1 | 9/1969 |
| DE | 19906687 | A1 | 8/2000 |
| EP | 190669 | A2 | 8/1986 |
| EP | 2157277 | A1 | 2/2010 |
| EP | 2505762 | A2 | 10/2012 |
| GB | 2492695 | B | 11/2017 |
| WO | 199630616 | A1 | 10/1996 |
| WO | 1999064712 | A1 | 12/1999 |
| WO | 2011146490 | A1 | 11/2011 |
| WO | 2013159153 | A1 | 10/2013 |
| WO | 2013173785 | A1 | 11/2013 |
| WO | 2016043719 | A1 | 3/2016 |
| WO | 2016149183 | A1 | 9/2016 |
| WO | 2017135929 | A1 | 8/2017 |

OTHER PUBLICATIONS

Pittard et al., "Directional Drilling Motors Evolve for Demanding Downhole Environments", Upstream Plumbing, <http://www.upstreampluming.com/article/drilling/2015/directional-drilling-motors> May/Jun. 2015 (6 pages).

Bahco, "Screwdriver Catalogue" ERGO Screwdrivers, Hexagonal, Hex Ball Double handle, 2016, cover, pp. 13-14.

Terra Trenchless Technologies, Product List, HHD Horiziontal Directional Drilling, Rod Connectors (Drive Chucks), Sub Savers, Drill Rod Connector 170/API-36pin (MJLV), Mar. 22, 2017 (1 page).

ChinA-ogpe.com, Product Directory, Oil Field Tool, Other Oil Field Tools, taper drill rod (flr032), Mar. 3, 2017 (2 pages).

Zen Cart, "Rineer M057 Hyrdaulic Rotary Head", Product Information, <http://driller.com/v2/rineer-m057-hydraulic-rotary-head-2473 html>, Mar. 22, 2017 (3 pages).

CMW, "JT4020 Mach 1/All Terrain" Operators Manual, Issue 5.1, Copyright 2007, 2011, pp. Service—202, 210, 221.

* cited by examiner

DUAL ROD DIRECTIONAL DRILLING SYSTEM

BACKGROUND

Dual drill rod drilling systems ("dual rod") for use in directional drilling having an inner rod and an outer rod are known. A typical dual rod drilling system is generally configured to drive into the ground a series of drill rods joined end-to-end to form a drill string. At the end of the drill string is a rotating drilling tool or drill bit. A dual rod drilling system typically includes a first drive mechanism that controls rotation of a drill bit and a second drive mechanism that controls rotation of a steering element. When a straight hole is drilled with a dual rod drilling system, the first and second drive mechanisms are concurrently operated such that both the drill bit and the steering element are rotated as the drill string is thrust into the ground. When a directional change is needed, because the steering element is axially misaligned with the drill string, the drive mechanism that controls the steering element is stopped and the drill string is thrust further into the ground while the drive mechanism that controls the drill bit is rotated. This causes the drill bit to deviate from a straight path and follow the direction dictated by the steering element.

Dual rod drilling systems also use drilling fluid that is passed internally within the drill rods for cooling of the drill bit and also for transporting cuttings within the drill hole. Therefore, to ensure proper operation, it is important to reduce obstructions within the drilling fluid flow path. However, this can be difficult due to the unavoidable relative longitudinal offsets between inner and outer drill rods within the drill string.

Further, the inner and outer drill rods of each drill rod assembly can have variations in length resulting from manufacturing tolerances. Because of the length variations, drill rod assemblies are designed such that the overall length of interconnected inner drill rods are never longer than the overall length of interconnected outer drill rods. If the interconnected inner drill rods were longer than the outer drill rods, the inner rods would collide while the outer drill rods were being coupled together, causing damage to one or both of the inner and outer drill rods. Accordingly, by design, the length of interconnected inner drill rods is slightly less than the length of interconnected outer drill rods. However, this design requirement results in a situation where certain portions of the drill string, e.g., the inner drill rods, contact the outer drill rods and obstruct the fluid flow path. This results in being able to send less drilling fluid to the drill head and/or possible damage to portions of the drill string. Therefore, improvements in maintaining an open drilling fluid flow path are needed.

To drive the drill bit with the first drive mechanism, flexible and/or bent drive shafts have been used in order to allow steering and still facilitate torque transfer. Other designs have used a coupling (sometimes referred to as a "transmission") so as to allow misalignment between a straight drill bit shaft and a straight drive shaft. However, such a coupling, or transmission, has traditionally included several components and required separate lubrication and isolation from the drilling fluid, thus complicating manufacture and maintenance. Therefore, improvements to the drill head of a dual rod drilling system are needed.

To drive the rotation of the drill string, a gearbox having a plurality of motors has traditionally been used. The gearbox can include a gear arrangement that transfers power from the plurality of motors to the inner and outer drill rods of the dual rod drilling system. Drilling fluid has also been traditionally introduced at the gearbox to the drill string; however, isolating the drilling fluid from the internal components of the gearbox can be difficult. Further, should a malfunction occur and drilling fluid be introduced to the interior of the gearbox, due to the internal positioning of the gearbox components, it is difficult for an operator to realize this before the components of the gearbox are damaged.

SUMMARY

The present disclosure relates generally to a dual rod horizontal directional drilling system. In one possible configuration, and by non-limiting example, the horizontal directional drilling system includes a drive coupling with a central bore that is a through bore and a drive shaft that is self-aligning with the drive coupling to minimize detrimental forces within the drill head.

In one aspect of the present disclosure, a drill head for a horizontal directional drilling system is disclosed. The drill head includes an uphole portion, a downhole portion and a drive coupling. The uphole portion includes a main casing, a drive shaft, and a drive shaft fluid flow passage. The main casing includes a main casing axis and an inner diameter. The drive shaft that includes a downhole end. The downhole end includes an enlarged portion that has drive features that are torque transmitting and radial load bearing. The drive shaft has a drive shaft axis and an outer diameter. The drive shaft axis is aligned with the main casing axis, and the enlarged portion has a maximum diameter and a generally spherical shape that defines a centroid. The drive shaft fluid flow passage is between the inner diameter of the main casing and the outer diameter of the drive shaft. The downhole portion includes an end casing connected to the main casing. The end casing has an end casing axis that is misaligned with the main casing axis. The end casing axis and the main casing axis intersect at a balance point of the drill head. The downhole portion includes a drill bit shaft that has a drill bit shaft axis and an inner fluid flow cavity. The drill bit shaft has an uphole end that includes drive features that are torque transmitting and radial load bearing. The drill bit shaft axis is not aligned with the drive shaft axis. The drive coupling has an uphole end and a downhole end. The drive coupling includes a central through bore that has a central bore axis. The central through bore includes drive features disposed within the central through bore, and the drive features at the uphole end of the drive coupling receive the drive features of the drive shaft, and the drive features at the downhole end of the drive coupling receive the drive features of the drill bit shaft. The drive coupling is configured to transfer rotation between the drive shaft and the drill bit shaft, and the drive coupling further includes at least one radial fluid flow passage. The drive shaft fluid flow passage, the central through bore of the drive coupling, the at least one radial fluid flow passage of the drive coupling, and the inner fluid flow cavity of the drill bit shaft are in fluid communication. The downhole end of the drive shaft is movable within the central through bore of the drive coupling along the central bore axis. The drive shaft is positioned where the centroid of the enlarged portion of the drive shaft is coincident with the balance point of the drill head.

In another aspect of the present disclosure, a drive coupling of a horizontal directional drilling drill head is disclosed. The drive coupling includes an uphole end and a downhole end. The drive coupling includes a central through bore that has a central bore axis. The central through bore includes drive features disposed therein. The drive features at the uphole end of the drive coupling are configured to mate with drive features of a drive shaft. The drive features at the downhole end of the drive coupling are configured to receive drive features of a drill bit shaft. The central through bore of the drive coupling has a consistent maximum diameter from the uphole end to the downhole end of the drive coupling. The drive coupling includes at least one radial fluid flow passage between an exterior surface of the drive coupling and the central through bore. The drive coupling includes balancing features disposed on the exterior surface at the uphole end of the drive coupling.

In another aspect of the present disclosure, a method of aligning a drive shaft within a drive coupling in a horizontal directional drilling drill head is disclosed. The method includes providing a main casing with a main casing axis and an inner diameter and a drive shaft positioned at least partially within the main casing. The drive shaft has a downhole end that includes an enlarged portion that has drive features that are torque transmitting and radial load bearing. The drive shaft has a drive shaft axis and an outer diameter. The enlarged portion has a maximum diameter and a generally spherical shape that defines a centroid. The method includes providing an end casing connected to the main casing, the end casing having an end casing axis that is misaligned with the main casing axis. The end casing axis and the main casing axis intersect at a balance point of the drill head. The method includes providing the drive coupling positioned within the end casing. The drive coupling has an uphole end and a downhole end. The drive coupling includes a central through bore having a central bore axis. The central through bore includes drive features disposed within the central through bore. The drive features at the uphole end of the drive coupling receive the drive features of the drive shaft, and the downhole end of the drive shaft is movable within the central through bore of the drive coupling along the central bore axis. The method includes aligning the centroid of the enlarged portion of the drive shaft to be coincident with the balance point of the drill head.

The present disclosure additionally or alternatively relates generally to a dual rod horizontal directional drilling system. In one possible configuration, and by non-limiting example, the horizontal directional drilling system includes a drill head that includes a flow insert positioned therein to allow fluid flow within a drive coupling and to a drill bit shaft.

In one aspect of the present disclosure, a drive arrangement for a horizontal directional drilling drill head is disclosed. The drive arrangement includes a drive shaft that has a downhole end that includes drive features that are torque transmitting and radial load bearing. The drive arrangement includes a drill bit shaft that has a drill bit shaft axis and an inner fluid flow cavity. The drill bit shaft has an uphole end that includes drive features. The drive arrangement includes a drive coupling that has an uphole end and a downhole end. The drive coupling includes a central bore that has a central bore axis. The central bore includes drive features disposed within the central bore. The drive features of the uphole end of the central bore receive the drive features of the drive shaft, and the drive features of the downhole end of the central bore receive the drill bit shaft drive features. The drive coupling is configured to transfer rotation between the drive shaft and the drill bit shaft, and the drive coupling further includes at least one radial fluid flow passage. The drive arrangement includes a flow insert positioned within the central bore of the drive coupling between the drive shaft and the drill bit shaft. The flow insert is axially movable within the central bore along the central bore axis, and the flow insert includes an axial fluid flow passage and at least one radial fluid flow passage. The axial fluid flow passage and the at least one radial fluid flow passage of the flow insert allow fluid to pass through the at least one radial fluid flow passage of the drive coupling and into the inner fluid flow cavity of the drill bit shaft.

In another aspect of the present disclosure, a drive arrangement of a horizontal directional drilling drill head is disclosed. The drive arrangement includes a drive coupling that includes an uphole end and a downhole end. The drive coupling includes a central bore that has a central bore axis. The central bore includes drive features disposed therein. The drive features of the uphole end of the central bore are configured to mate with drive features of a drive shaft, and the drive features of the downhole end of the central bore are configured receive drive features of a drill bit shaft. The drive coupling includes at least one radial fluid flow passage between an exterior surface of the drive coupling and the central bore. The drive coupling includes balancing features disposed on the exterior surface at the uphole end. The drive arrangement includes a flow insert positioned within the central bore of the drive coupling. The flow insert is movable within the central bore along the central bore axis. The flow insert includes an uphole axial side and a downhole axial side. The flow insert includes an axial fluid flow passage that permits fluid flow between the uphole axial side and the downhole axial side. The flow insert includes at least one radial fluid flow passage connected to the axial fluid flow passage. The axial fluid flow passage and the at least one radial fluid flow passage of the flow insert are in fluid communication with the at least one radial fluid flow passage of the drive coupling.

In another aspect of the present disclosure, a flow insert for use in a drive arrangement of a horizontal directional drilling drill head is disclosed. The flow insert includes an inner axial fluid flow passage disposed between an uphole axial side and a downhole axial side. The flow insert includes at least one outer axial fluid flow passage disposed between the uphole axial side and the downhole axial side. The at least one radial outer axial fluid flow passage is radially spaced from the inner axial fluid flow passage. The at least one radial outer axial fluid flow passage is connected to the inner axial fluid flow passage. The flow insert is positionable and axially movable within an inner bore of a drive coupling.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
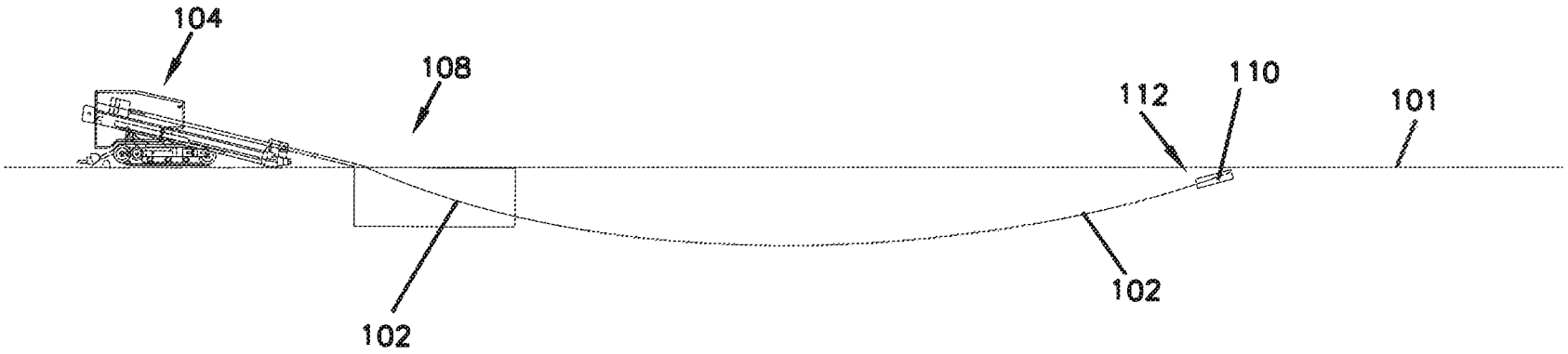
FIG. 1 illustrates a schematic side view of a drilling machine and a drill string, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
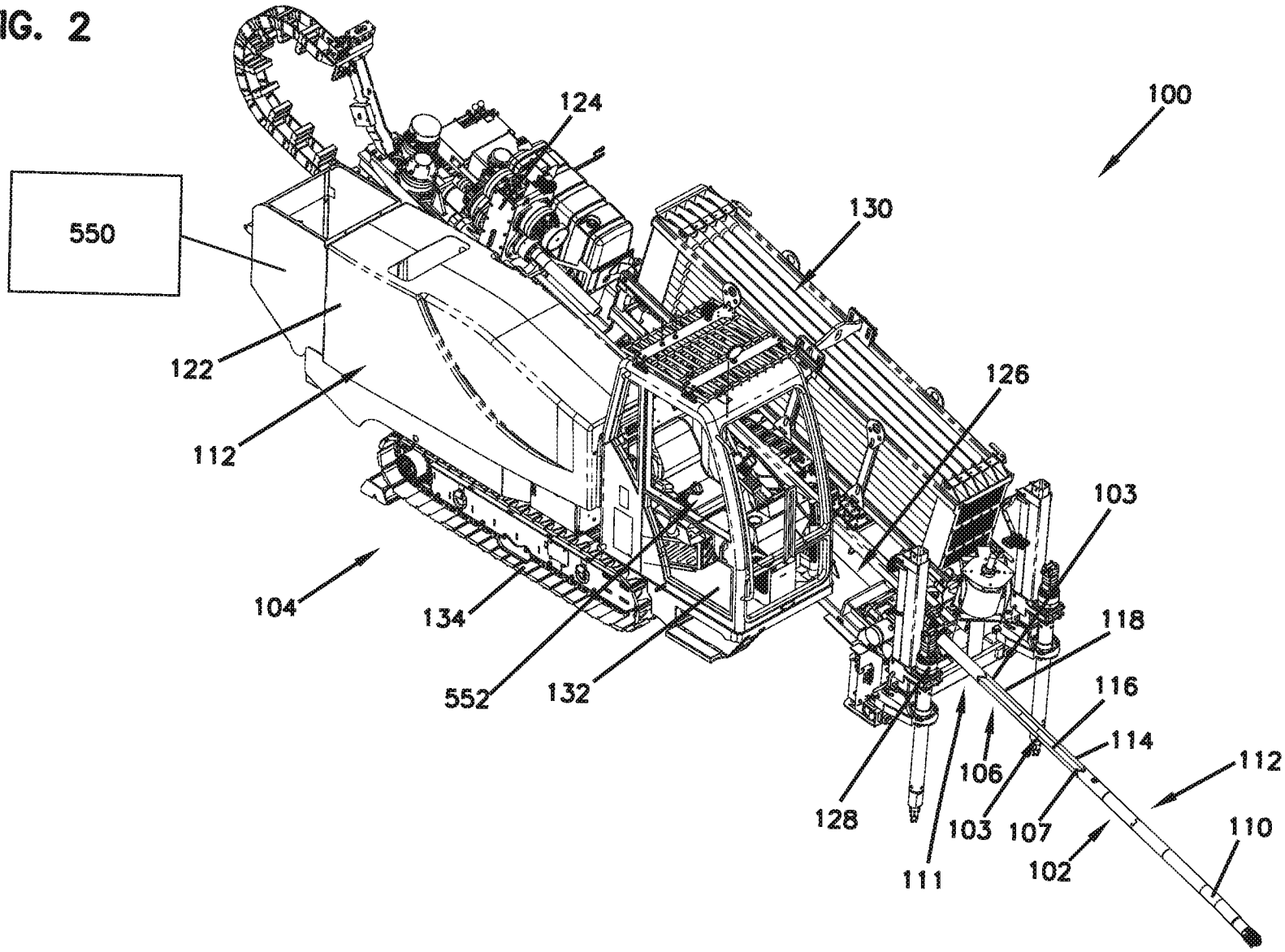
FIG. 2 illustrates a perspective view of a drilling machine, according to one embodiment of the present disclosure.

FIGS. 1 and 2 show a dual rod drilling system 100. The dual rod drilling system 100 includes a drill string 102 that is directed into the ground 101 by a drilling machine 104. An example drill string 102 is shown in FIG. 1.

The drilling machine 104 includes a prime mover 122 (e.g., a diesel engine), gearbox 124, a rack 126, and a break out mechanism 128 (e.g., a vise system). Optionally, the drilling machine 104 can include a drill rod storage box 130, an operator's station 132, and a set of tracks or wheels 134.

The drill string 102 consists of individual sections of drill rod assemblies 106 that are connected to the drilling machine 104 at an uphole end 108 and a drill head 110 at a downhole end 112. Each drill rod assembly 106 includes a downhole end 109 and an uphole end 111. The drill rod assemblies 106 are strung together end-to-end to form the drill string 102, which can extend significant distances in some drilling applications.

Each drill rod assembly 106 includes a tubular outer drill rod 114. In some examples, the outer drill rod 114 has external threads on one end and internal threads on the opposite end. In some examples, the drill rod assembly 106, and the associated drilling machine 104, is configured so that, when the drill string 102 is constructed, the external threads of the outer drill rod 114 are positioned at the uphole end 111 of the drill rod assembly 106 and the internal threads of the outer drill rod 114 are positioned at the downhole end 109 of the drill rod assembly 106.

Each drill rod assembly 106 further includes a smaller, inner drill rod 116. The inner drill rod 116 fits inside the tubular outer drill rod 114. The inner drill rod 116 of each drill rod assembly is interconnected to the adjacent inner drill rod by an inner rod coupling 118. In some examples, each inner rod coupling 118 is affixed to each inner drill rod 116 at the uphole end 111 of each drill rod assembly 106.

In some examples, the drill string 102 can have multiple fluid flow paths such as an annular fluid flow path disposed between the inner and outer drill rods 116, 114. In some examples, the drill string also includes an inner fluid flow path disposed within the inner drill rod 116. In operation, fluid is pumped into the drill rod assembly 106 and travels to the drill head 110 for cooling, transporting cuttings, lubricating, and drill hole stabilizing.

During a drilling operation, the drilling machine 104 individually removes drill rod assemblies 106 from the drill rod storage box 130 and moves each drill rod assembly 106 onto the rack 126. Once positioned on the rack 126, both the break out mechanism 128 and the gearbox 124 engage the drill rod assembly 106 and couple the drill rod assembly 106 with an immediately preceding downhole drill rod assembly 106. Once coupled, the gearbox 124 is configured to travel longitudinally on the rack 126 toward the break out mechanism 128, while simultaneously rotating one or both of the outer and inner drill rods 114, 116 of the drill rod assembly 106. When the gearbox 124 reaches the break out mechanism 128 at the end of the rack 126, the gearbox 124 is de-coupled from the drill rod assembly 106, and thereby the drill string 102, and retracts up the rack 126 so that another drill rod assembly 106 can be added to the drill string 102. This process is repeated until the drilling operation is complete, and then reversed during a pullback operation in which the drilling machine 104 removes the drill rod assemblies 106 from the ground 101.

The dual rod drilling system 100 is operable to execute a plurality of software instructions that, when executed by a controller 550, cause the system 100 to implement the methods and otherwise operate and have functionality as described herein. In some examples, the controller 550 is in communication the prime mover 122, gearbox 124, rack 126, break out mechanism 128, operator's station 132, and/or other components of the system 100. The controller 550 may comprise a device commonly referred to as a microprocessor, central processing unit (CPU), digital signal processor (DSP), or other similar device, and may be embodied as a standalone unit or as a device shared with components of the system 100. The controller 550 may include memory for storing software instructions, or the system 100 may further comprise a separate memory device for storing the software instructions that is electrically connected to the controller 550 for the bi-directional communication of the instructions, data, and signals therebetween. In some examples, the controller 550 waits to receive signals from the operator's station 132 before communicating with and operating the components of the drilling machine 104. In other examples, the controller 550 can operate autonomously, without receiving signals from the operator's station 132, to communicate with and control the operation of the components of the drilling machine 104.

The operator's station 132 can be mounted to the drilling machine 104 to allow an operator to control the operation of the drilling machine 104. In some examples, the operator's station 132 includes a plurality of controls 552 with which the operator can interact to control the components of the drilling machine 104. In some examples, the controls 552 include joysticks, knobs, buttons, and the like. In some examples, the controls 552 can be in communication with the controller 550. In some examples, as the user interacts with the controls 552, the controls 552 generate a signal that is sent to the controller 550 that can indicate operations the user would like the drilling machine 104 to perform. Such operations can include, but not be limited to, separate rotation of the inner and outer drill rods 116 via the gearbox 124, movement of the gearbox 124 via the rack 126 on the drilling machine 104, and operation of the break out mechanism 128. In some examples, the controls 552 and controller 550 are an open loop system and there does not exist any feedback between the drilling machine 104's actual operation and the controller 550 and controls 552. In other examples, the controls 552 and controller 550 are a closed loop system and there exists feedback between the drilling machine 104's operation and the controller 550 and controls 552. In such a closed loop system, a plurality of sensors can be used to monitor the performance of the components of the drilling machine 104.

Figure 3:
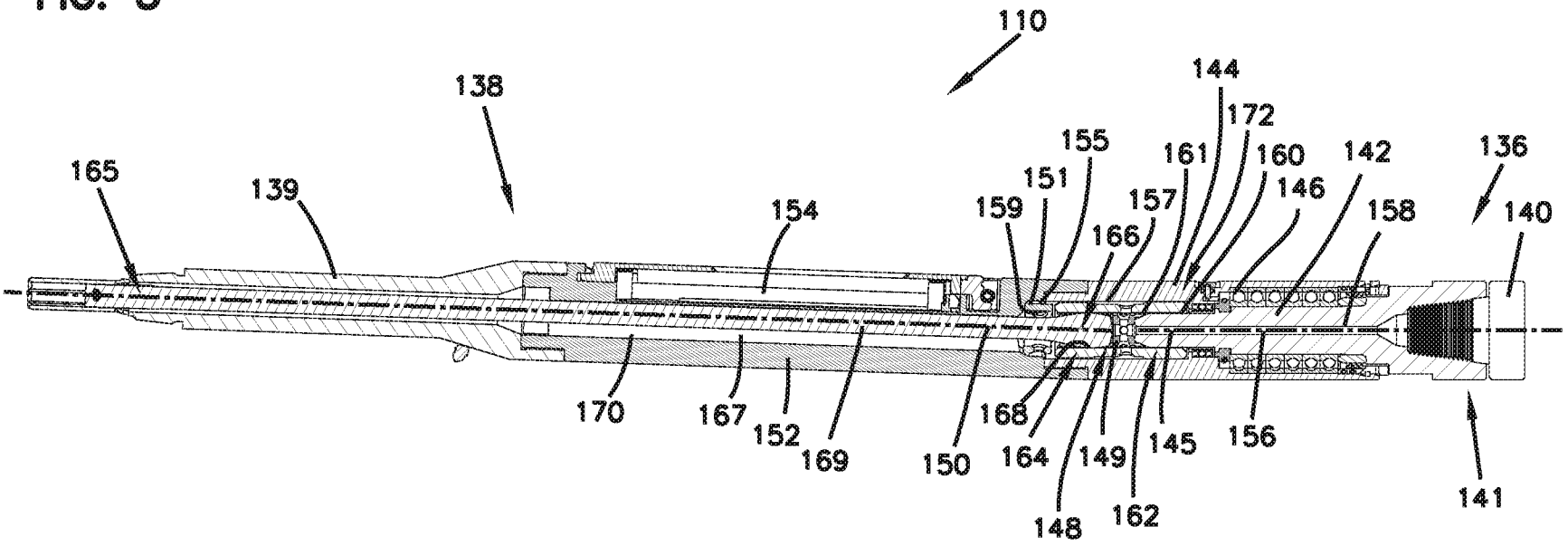
FIG. 3 illustrates a side cross-sectional view of a drill head, according to one embodiment of the present disclosure.

FIG. 3 shows a longitudinal cross-section of the drill head 110. The drill head 110 is connectable to the outer drill rods 114 and inner drill rods 116 of the drill string 102. The drill head 110 includes a downhole end 136 and an uphole end 138. Further, the drill head 110 includes a replaceable drill bit 140, a drill bit shaft 142, an end casing 144, a plurality of drill bit shaft bearings 146, a drive coupling 148, a flow insert 149, flow collar 151, a drive shaft 150, a main casing 152, and an optional sonde 154 (i.e., probe or beacon) positioned within the main casing 152. In some examples, the drill head 110 can include an outer rod adapter 139 to connect the drill head 110 to the outer drill rods 114 of the drill string 102 and the inner rod coupling 118 to connect the drill head 110 to the inner drill rod 116.

The inner drill rods 116 of the drill string 102 are collectively used to drive the rotation of the drill bit 140 via the drive shaft 150, the drive coupling 148, and the drill bit shaft 142. The outer drill rods 114 of the drill string 102 are collectively used to rotate and/or control the rotational orientation of the main casing 152, which is connected to the end casing 144.

The replaceable drill bit 140 can have a variety of different configurations and, in some examples, can be a tri-cone bit. The replaceable drill bit 140 is mounted to a downhole end 141 of drill bit shaft 142 at the downhole end 136 of the drill head 110.

The drill bit shaft 142 is rotatably mounted within the end casing 144 via the drill bit shaft bearings 146 making the drill bit shaft 142 rotatable relative to the end casing 144 along a drill bit shaft axis 156. The drill bit shaft axis 156 is aligned with an end casing axis 158. The drill bit shaft 142 includes drive features 160 that are configured to mate with the drive coupling 148 to facilitate torque transfer between the drive coupling 148 and the drill bit shaft 142. The drill bit shaft 142 also includes an inner fluid flow cavity 145 that allows drill fluid flow to transfer from the drill string 102 to the drill bit 140.

The drive coupling 148 is positioned between the drill bit shaft 142 and the drive shaft 150 within a recess 157 of the end casing 144 to facilitate the transfer of torque between the drive shaft 150 and the drill bit shaft 142. Specifically, the drive coupling 148 receives the drill bit shaft 142 at a downhole end 162 and the drive shaft 150 at an uphole end 164. The drive coupling 148 includes a central bore 161 to allow fluid flow from the uphole end 164 to the downhole end 162 and then on to the inner fluid flow cavity 145 of the drill bit shaft 142. The flow insert 149 is positioned and axially movably within the central bore 161 between the drive shaft 150 and the drill bit shaft 142.

The drive shaft 150 includes a downhole end 166 and an uphole end 165. The uphole end 165 is configured to attach to the inner drill rods 116 of the drill string 102. The downhole end 166 includes drive features 168 that are torque transmitting and radial load bearing. The downhole end 166 of the drive shaft 150 is configured to mate have an outer profile that is generally spherical, ellipsoid, or a prolate spheroid. In some examples, the drive features 168 form a polygonal lateral cross-sectional profile. In some examples, the drive features 168 form a profile that has a generally hexagonal transverse cross-section. In other examples still, a portion of the downhole end 166 is a crowned spline. The drive features 168 can form any cross-sectional profile that is configured to transfer torque while minimizing friction and the potential for jamming (e.g., lobes, flat faces, curved faces, etc.). In some examples, the drive features 168 are at least partially heat treated. It is considered within the scope of the present disclosure that the drive shaft 150 and drive coupling 148 can have generally rounded longitudinal cross-sectional profiles.

The drive shaft 150 is rotatable about a drive shaft axis 167 and is positioned within the main casing 152. In the depicted example, the drive shaft axis 167 is aligned with a main casing axis 169. The drive shaft axis 167 is not aligned and is not parallel with the end casing axis 158 and the drill bit shaft axis 156. In some examples, the drive shaft axis 167 and the drill bit shaft axis 156 are angled at an angle θ with respect to one another between about 1 degree and 5 degrees. In some examples, the drive shaft axis 167 and the drill bit shaft axis 156 are angled at an angle θ equal to about 2 degrees from one another. In some examples, the misalignment can be adjustable to alter the steering characteristics of the drill head 110.

The drive shaft 150 has an outer diameter OD that is smaller than an inner diameter ID of the main casing 152. A drive shaft fluid flow passage 170 is disposed between the inner diameter ID of the main casing 152 and the outer diameter OD of the drive shaft 150. In some examples, the drive shaft fluid flow passage 170 is an annular fluid flow passage between the drive shaft 150 and the main casing 152. The drive shaft fluid flow passage 170 is in communication with a fluid flow path 103 of the drill string 102 at the uphole end 138 of the drill head 110. Further, due to the location of the drive coupling 148 and the drive shaft 150, the drive coupling 148 and drive shaft 150 are surrounded by fluid flow from the drive shaft fluid flow passage 170. This allows drilling fluid to be in communication with the drive features 168 of the drive shaft 150 and the uphole end 164 of the drive coupling 148.

The flow collar 151 is shown positioned around drive shaft 150, adjacent the drive coupling 148. In some examples, the main casing 152 defines a recess 155 in communication with the recess 157 of the end casing 144 when the end casing 144 and the main casing 152 are attached to one another. In some examples, the flow collar 151 is positioned within the recess 155 of the main casing 152, around the drive shaft 150. The flow collar 151 aids in preventing axial movement of the drive coupling 148 within the recess 157 of the end casing 144, yet also permits fluid flow from around the drive shaft 150 to around the drive coupling 148. The flow collar 151 includes a plurality of peripheral fluid passages 159 to allow fluid flow from the fluid flow path 103 around the drive shaft 150 to an annular fluid flow passage 153 defined between the flow collar 151 and the recess 155 and also between the recess 157 and the drive coupling 148. Therefore, fluid is not only allowed around the drive shaft 150 within the drive coupling 148 (i.e., coupling lubrication), but fluid flow is also facilitated by the flow collar 151 to flow around the drive coupling 148 within the recess 157. In some examples, the flow collar 151 is positioned within the recess 157. In some examples, the flow collar 151 is positioned to move freely within the recess 155. In other examples, the flow collar 151 is press fit into at least one of the recesses 155, 157.

Figure 4:
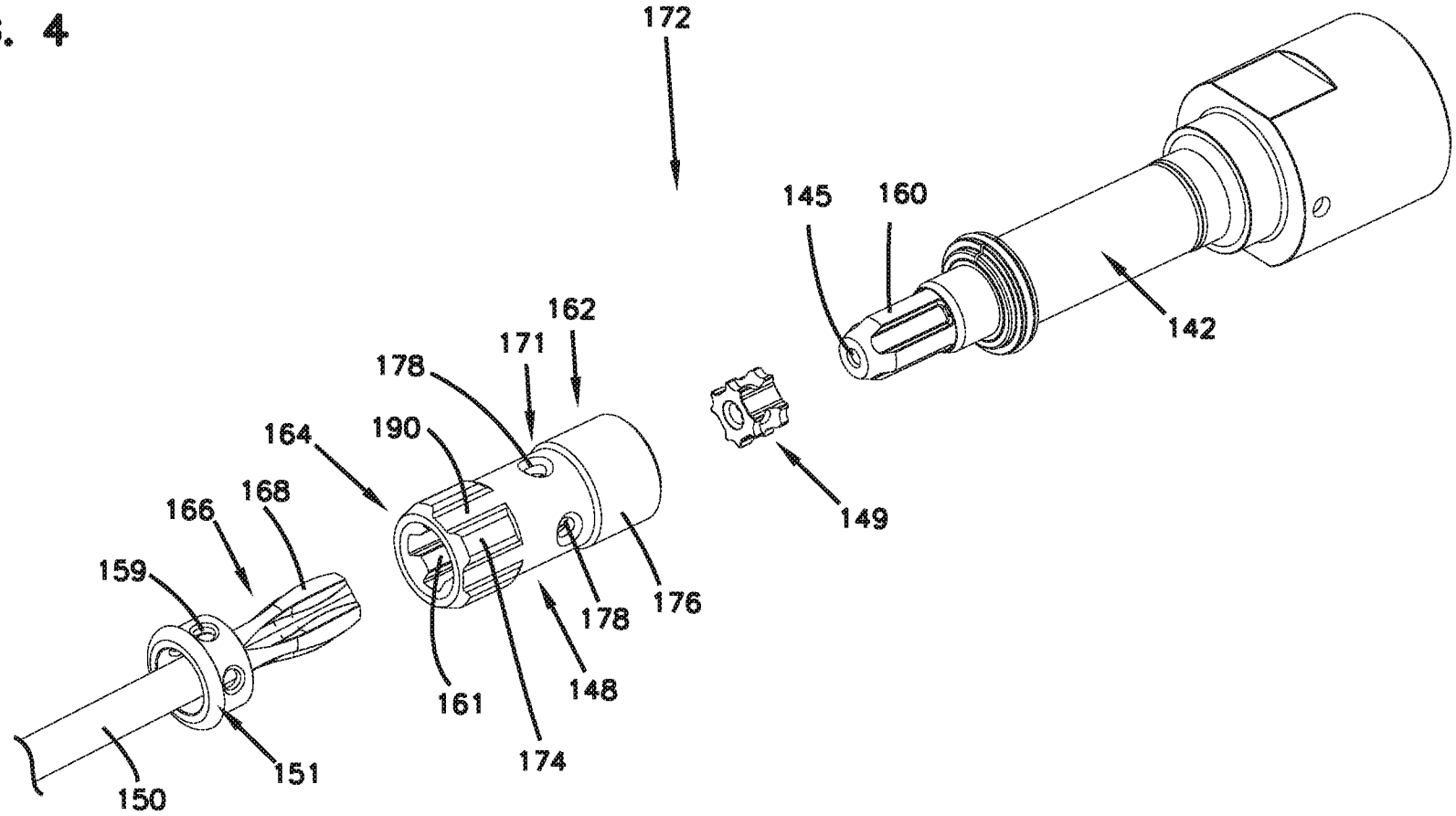
FIG. 4 illustrates a partially exploded view of a portion of the drill head of FIG. 3.

FIG. 4 shows a partial exploded view of an inner assembly 172 of the drill head 110 that includes the drive shaft 150, the drive coupling 148, the flow insert 149, the flow collar 151, and the drill bit shaft 142. The inner assembly 172 is configured to drive the rotation of the drill bit 140 via the inner drill rod 116 of the drill string 102. The drill bit shaft 142 and the drive shaft 150 are both straight members that are axially misaligned at the drive coupling 148. In some examples, the misalignment of the drive shaft 150 with the drive coupling 148 is adjustable.

Figure 5:
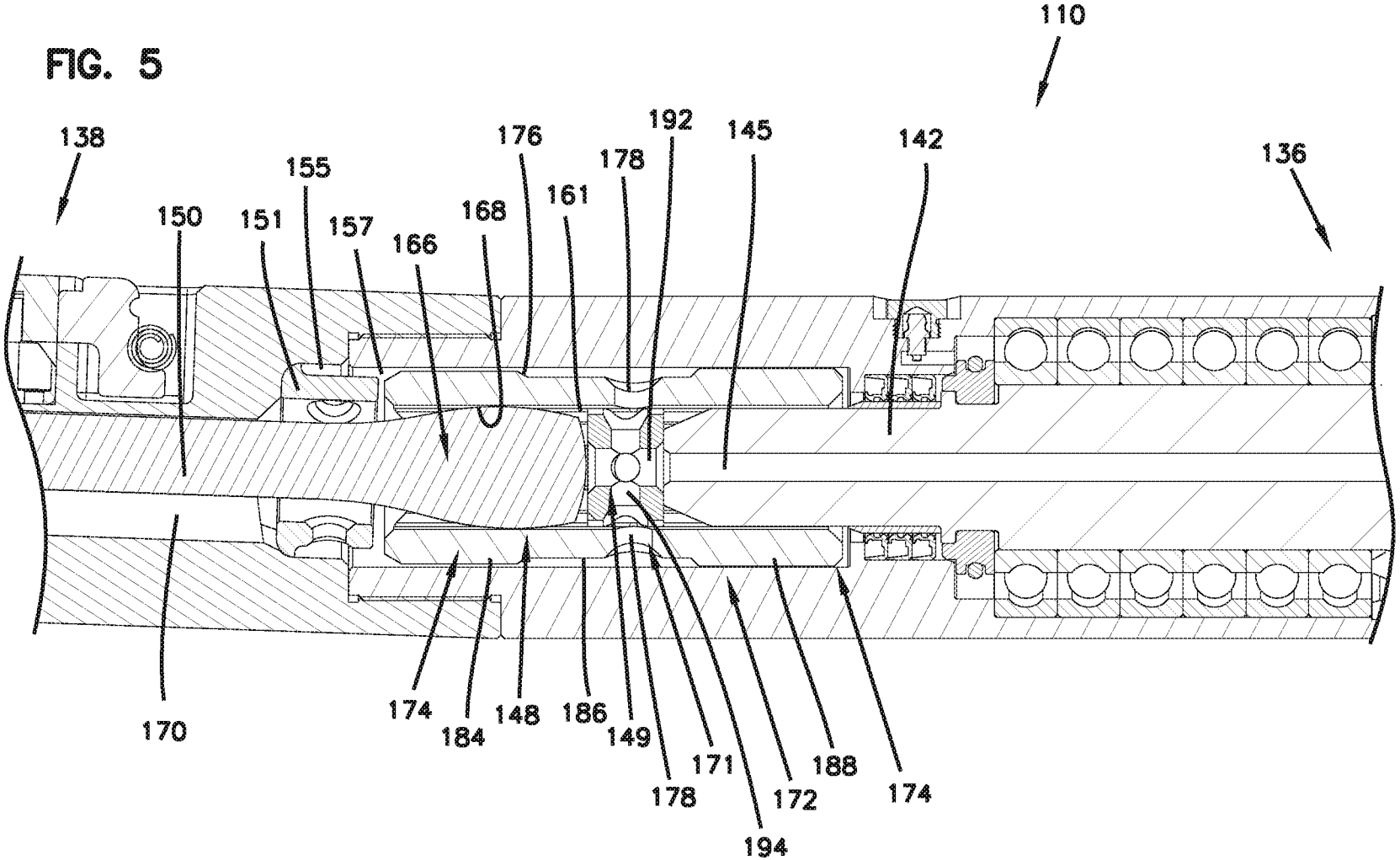
FIG. 5 illustrates a zoomed-in cross-sectional side view of the drill head of FIG. 3.

FIG. 5 shows a zoomed-in portion of the downhole end 112 of the drill head 110. In the depicted examples, the flow insert 149 is positioned within the central bore 161 to allow the flow insert 149 to freely move within the central bore 161. In some examples, the drive coupling 148 and/or the drive shaft 150 can be assembled with one another to prevent decoupling from one another during a drilling operation. In some examples, the assembly can include press-fitting the drive coupling 148 and drive shaft 150 together. In some examples, the assembly to prevent decoupling can include heating at least one of the drive coupling 148 and drive shaft 150 prior to coupling. In some examples, the assembly to prevent decoupling can include providing a seam on the drive coupling 148 (or the drive shaft 150) to allow the drive coupling 148 to be separated into multiple pieces. The multiple pieces can then be secured around the drive shaft 150 by, for example, a fastener such as an adhesive, a bolt(s), a screw(s), a weld, or other type of fastener.

The drive shaft 150 is shown to be positioned within the central bore 161 of the drive coupling 148 so that it is aligned with a connection of the end casing 144 and the main casing 152, transverse to the end casing axis 158.

The drive coupling 148 is shown to include the central bore 161, at least one coupling fluid flow passage 171, and balancing features 174 positioned on an exterior surface 176.

The central bore 161 is configured to be a through-bore within the drive coupling so that the central bore 161 travels from the uphole end 164 to the downhole end 162. In some examples, the central bore has a consistent profile throughout. In some examples, the central bore can be formed in a way to ease manufacturing. In some examples broaching can be utilized to form the central bore 161.

The coupling fluid flow passage 171 can include a plurality of radial fluid flow passages 178 extending between the exterior surface 176 and the central bore 161 (see FIG. 4). In some examples, the radial fluid flow passages 178 are circumferentially positioned around the drive coupling 148 to allow fluid from around the drive coupling 148 to enter the central bore 161. In some examples, the radial fluid flow passages 178 are apertures such a holes, slots, or the like.

The exterior surface 176 of the drive coupling 148 includes portions that have different outer dimensions (e.g., outer diameters) to allow fluid flow around the drive coupling 148 within the recess 157 of the end casing 144. Specifically, fluid flow is permitted around the exterior surface 176 of the uphole end 164 of the drive coupling 148. Fluid travels in and out of the radial fluid flow passage 178 so as to lubricate the central bore 161 while also providing fluid flow to the inner fluid flow cavity 145 of the drill bit shaft 142. Therefore, portions 180 of the exterior surface 176 are dimensioned smaller than the recess 157 of the end casing 144 to allow fluid flow therebetween. However, alignment of the drive coupling 148 within the recess 157 is desired to reduce premature wear. In order to stabilize the drive coupling 148 within the recess 157, the drive coupling 148 includes the balancing features 174 disposed on exterior surface 179 that are configured to aid in stabilizing the drive coupling 148 within the recess 157 of the end casing 144. Sufficient space is maintained between the recess 157 and the drive coupling 148, because, during a drilling operation, the drive shaft 150 transfers rotation to the bit shaft 142 through the drive coupling 148, thereby rotating the drive coupling 148. Because of this, at least at points during the drilling operation, the drive coupling 148 rotates with the drive shaft 150 within, and relative to, the recess 157 in the end casing 144.

The balancing features 174 are dimensioned more closely to the dimension of the recess 157, and larger than the portions 180, to permit rotational movement between the drive coupling 148 and the recess 157, but limit substantial relative movement transverse to the end casing axis 158 between the drive coupling 148 and the recess 157. In some examples, this aids in reducing movement (e.g., wobbling) of drive coupling 148 generally perpendicular to the end casing axis 158. Such movement can be caused by bending forces exerted on the drive coupling 148 by the drive shaft 150. By reducing relative movement of the drive coupling 148 in the recess 157, the loosening of the connection between the drive shaft 150 and the central bore 161 of the drive coupling 148 is reduced, thereby limiting premature wear.

In some examples, the balancing features 174 include uphole balancing features 184 at the uphole end 164 and downhole balancing features 188 at the downhole end 162 of the drive coupling 148. However, because stabilizing and fluid flow is desired, especially around the uphole end 164, the uphole balancing features 186 include fluid flow passages 190 (see FIG. 4) to allow fluid flow between the uphole end 164 and the recess 157 of the end casing 144. The uphole balancing features 186 are shown as generally rectangular projections. However, it is considered within the scope of the present disclosure that the uphole balancing features can be configured in a variety of different ways to achieve stabilization and allow fluid flow therethrough. For example, the uphole balancing features can be at least partially spherical. In other examples, the uphole balancing features 186 can be secured to the exterior surface 179 of the drive coupling 148 by, for example, a fastener (e.g., bolt, adhesive, weld, etc.).

The flow insert 149, as described above, is positioned within the central bore 161 of the drive coupling 148, between the drive shaft 150 and the drill bit shaft 142. The flow insert 149 is axially free floating within the central bore 161 for free movement of the flow insert 149 when the drive shaft 150 and the drill bit shaft 142 move during operation. In some examples, the flow insert 149 does not rotate within the central bore 161 of the drive coupling. By allowing the flow insert 149 to free float within the central bore 161, undue wear on the coupling 148 is reduced. In some examples, the drive shaft 150 can axially move within the central bore 161 and interface with the flow insert 149 during operation. Such movement by the drive shaft 150 and drill bit shaft 142 aids in reducing axial loads on the drive shaft 150 and/or the drill bit shaft 142. Should the flow insert 149 become worn, the flow insert 149 can be easily replaced during a routine servicing of the drill head 110. Such replacement offers an inexpensive replacement part to the user.

The flow insert 149 includes a plurality of axial fluid flow passages 192 and a plurality of radial fluid flow passages 194. In some examples, the flow insert 149 includes at least one radial fluid flow passage 194. At least one of axial fluid flow passage 192 and the radial fluid flow passages 194 allow fluid to pass through the coupling fluid flow passage 171 of the drive coupling 148, specifically through the radial fluid flow passages 178, and into the inner fluid flow cavity 145 of the drill bit shaft 142.

Figure 7:
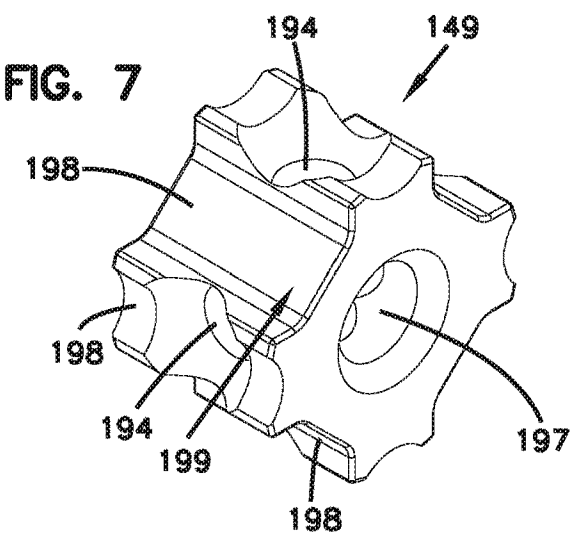
FIG. 7 illustrates another perspective view of the flow insert of FIG. 6.
Figure 9:
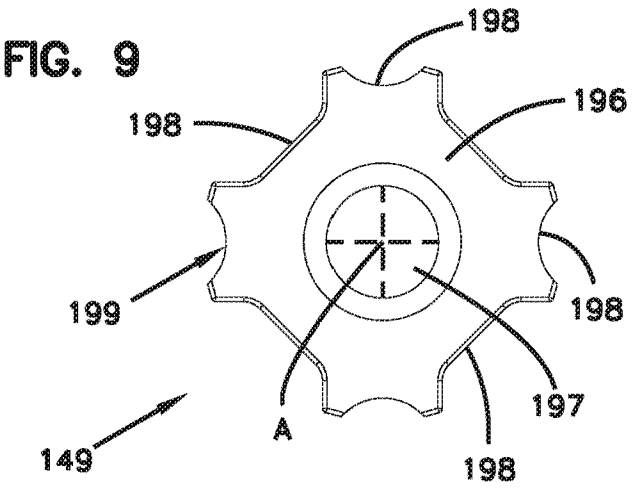
FIG. 9 illustrates another axial side view of the flow insert of FIG. 6.
Figure 6:
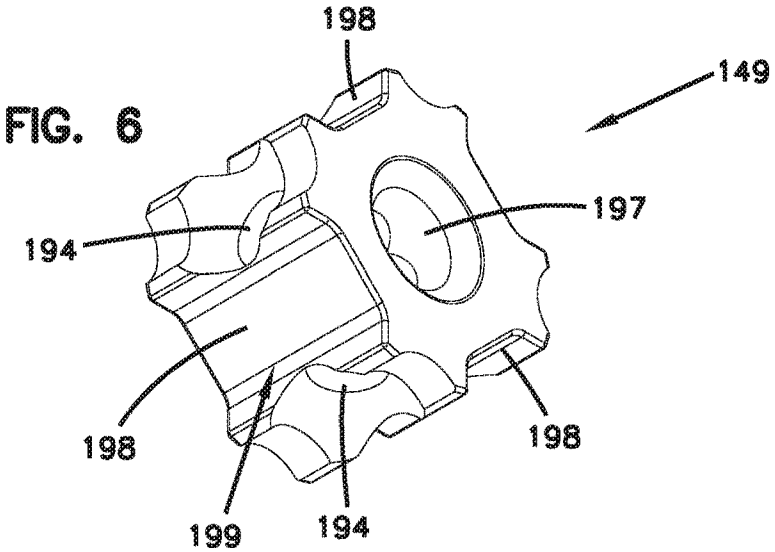
FIG. 6 illustrates a perspective view of a flow insert, according to one embodiment of the present disclosure.
Figure 8:
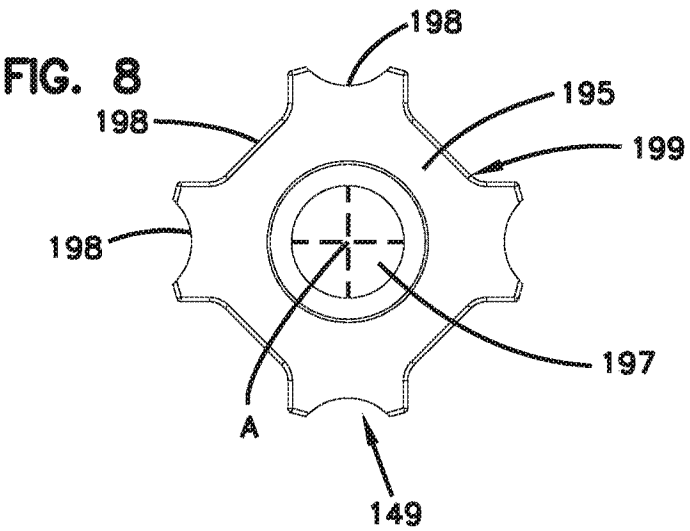
FIG. 8 illustrates an axial side view of the flow insert of FIG. 6.

FIGS. 6 and 7 show perspective views of the flow insert 149. FIGS. 8 and 9 show an end view of an uphole axial side 195 and an end view of a downhole axial side 196, respectively, of the flow insert 149. The flow insert 149 is configured so that radial movement of the flow insert 149 within the central bore 161 is minimized while also permitting axial movement within the central bore 161.

In some examples, the flow insert 149 can be at least partially ornamental in nature. As shown, the axial fluid flow passages 192 include an inner axial fluid flow passage 197 and a plurality of outer axial fluid flow passages 198.

The inner axial fluid flow passage 197 is disposed generally around a central axis A of the flow insert 149. The inner axial fluid flow passage 197 is disposed between the uphole axial side 195 and the downhole axial side 196.

The plurality of outer axial fluid flow passages 198 are also disposed between the uphole axial side 195 and the downhole axial side 196, but radially spaced from the inner axial fluid flow passage 197. In some examples, the outer axial fluid flow passages 198 are channels disposed in an exterior 199 of the flow insert 149 so that fluid can flow between the central bore 161 and the flow insert 149 between the uphole axial side 195 and the downhole axial side 196.

Figure 11:
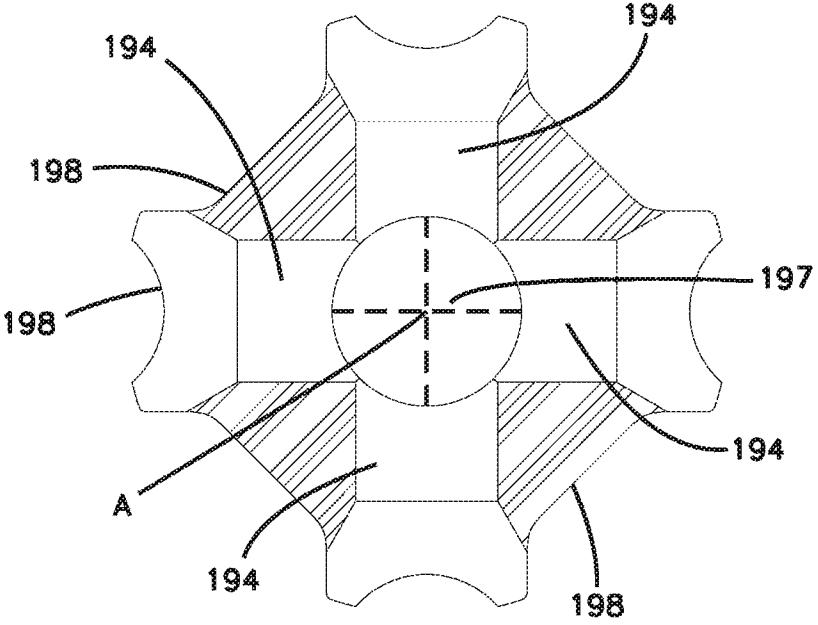
FIG. 11 illustrates cross-sectional axial side view along line 11-11 of the flow insert in FIG. 10.
Figure 10:
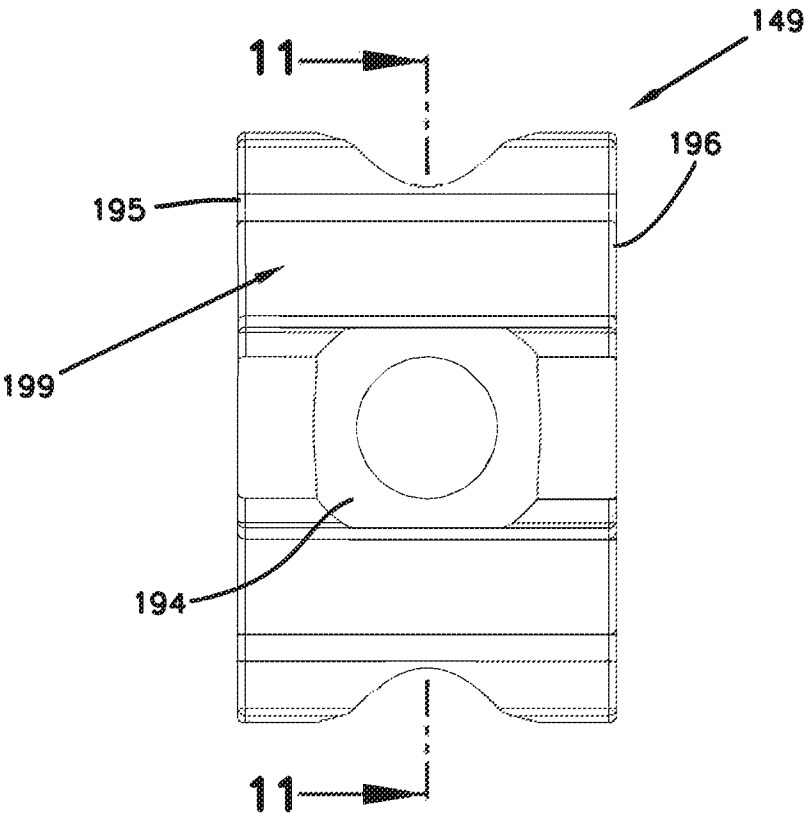
FIG. 10 illustrates a radial side view of the flow insert of FIG. 6.

FIG. 10 shows another side view of the flow insert 149, and FIG. 11 shows a cross-sectional view along line 11-11 of the flow insert 149. As shown, the radial fluid flow passages 194 are connected to the inner axial fluid flow passage 197 to allow fluid flow around the exterior 199 to the inner axial fluid flow passage 197. This allows fluid to enter the drive coupling 148 at the coupling fluid flow passage 171 at the exterior surface 179, flow around the flow insert 149 within the central bore 161, flow into the inner axial fluid flow passage 197, and flow into the inner fluid flow cavity 145 of the drill bit shaft 142.

It is considered within the scope of the present disclosure that the flow insert 149 can have a variety of different configurations to allow fluid flow within the central bore 161 and/or allow fluid flow from the coupling fluid flow passage 171 of the drive coupling 148 to the inner fluid flow cavity 145 of the drill bit shaft 142.

In an additional or alternative embodiment of the dual rod drilling system 100 the flow insert 149 may be eliminated. The following detailed description of such an additional or alternative embodiment provides exemplary aspects thereof.

Figure 12:
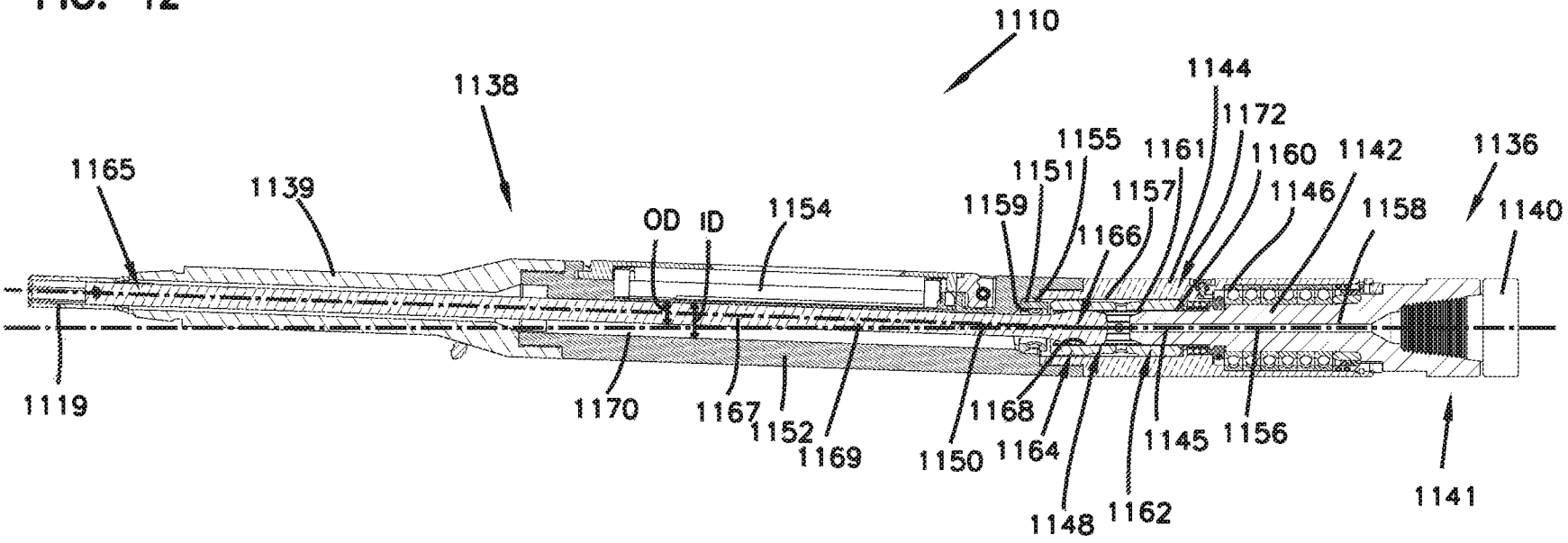
FIG. 12 illustrates a side cross-sectional view of a drill head, according to one embodiment of the present disclosure.

FIG. 12 shows a longitudinal cross-section of a drill head 1110. The drill head 1110 may be an additional or alternative embodiment of the drill head 110. The drill head 1110 is connectable to the outer drill rods 114 and inner drill rods 116 of the drill string 102. The drill head 1110 includes a downhole end 1136 and an uphole end 1138. Further, the drill head 1110 includes a replaceable drill bit 1140, a drill bit shaft 1142, an end casing 1144, a plurality of drill bit shaft bearings 1146, a drive coupling 1148, a flow collar 1151, a drive shaft 1150, a main casing 1152, and an optional sonde 1154 (i.e., probe or beacon) positioned within the main casing 1152. In some examples, the drill head 1110 can include an outer rod adapter 1139 to connect the drill head 1110 to the outer drill rods 114 of the drill string 102 and the inner rod coupling 118 to connect the drill head 1110 to the inner drill rod 116.

The inner drill rods 116 of the drill string 102 are collectively used to drive the rotation of the drill bit 1140 via the drive shaft 1150, the drive coupling 1148, and the drill bit shaft 1142. The outer drill rods 114 of the drill string 102 are collectively used to rotate and/or control the rotational orientation of the main casing 1152, which is connected to the end casing 1144.

The replaceable drill bit 1140 can have a variety of different configurations and, in some examples, can be a tri-cone bit. The replaceable drill bit 1140 is mounted to a downhole end 1141 of drill bit shaft 1142 at the downhole end 1136 of the drill head 1110.

The drill bit shaft 1142 is rotatably mounted within the end casing 1144 via the drill bit shaft bearings 1146, making the drill bit shaft 1142 rotatable relative to the end casing 1144 along a drill bit shaft axis 1156. The drill bit shaft axis 1156 is aligned with an end casing axis 1158. The drill bit shaft 1142 includes drive features 1160 that are configured to mate with the drive coupling 1148 to facilitate torque transfer between the drive coupling 1148 and the drill bit shaft 1142. The drill bit shaft 1142 also includes an inner fluid flow cavity 1145 that allows drill fluid flow to transfer from the drill string 102 to the drill bit 1140.

The drive coupling 1148 is positioned between the drill bit shaft 1142 and the drive shaft 1150. The drive coupling 1148 is specifically positioned within a recess 1157 of the end casing 1144 to facilitate the transfer of torque between the drive shaft 1150 and the drill bit shaft 1142. Specifically, the drive coupling 1148 receives the drill bit shaft 1142 at a downhole end 1162 and the drive shaft 1150 at an uphole end 1164. The drive coupling 1148 includes a central bore 1161 to allow fluid flow from the uphole end 1164 to the downhole end 1162 and then on to the inner fluid flow cavity 1145 of the drill bit shaft 1142.

The drive shaft 1150 includes a downhole end 1166 and an uphole end 1165. The uphole end 1165 is configured to attach to the inner drill rods 116 of the drill string 102. In some examples, the drive shaft 1150 is restrained from down-hole movement by an inner drill rod coupling 1119 attached to the uphole end 1165 of the drive shaft 1150. The inner drill rod coupling 1119 is prevented from moving inside the outer rod adapter 1139. The downhole end 1166 includes drive features 1168 that are torque transmitting and radial load bearing. In some examples, the drive features 1168 form a polygonal lateral cross-sectional profile. In some examples, the drive features 1168 form a profile that has a generally hexagonal transverse cross-section. In other examples still, a portion of the downhole end 1166 is a crowned spline. The drive features 1168 can form any cross-sectional profile that is configured to transfer torque while minimizing friction and the potential for jamming (e.g., lobes, flat faces, curved faces, etc.). In some examples, the drive features 1168 are at least partially heat treated. It is considered within the scope of the present disclosure that the drive shaft 1150 and drive coupling 1148 can have generally rounded longitudinal cross-sectional profiles. In some examples, the drive features 1168 can be machined. In other examples, the drive features 1168 are at least partially molded.

The drive shaft 1150 is rotatable about a drive shaft axis 1167 and is positioned within the main casing 1152. In the depicted example, the drive shaft axis 1167 is aligned with a main casing axis 1169. The drive shaft axis 1167 is not aligned with the end casing axis 1158 and the drill bit shaft axis 1156. In some examples, the drive shaft axis 1167 and the drill bit shaft axis 1156 are angled at an angle θ with respect to one another between about 1 degree and 5 degrees. In some examples, the drive shaft axis 1167 and the drill bit shaft axis 1156 are angled at an angle θ equal to about 2 degrees from one another. In some examples, the misalignment can be adjustable to alter the steering characteristics of the drill head 1110.

The drive shaft 1150 has an outer diameter OD that is smaller than an inner diameter ID of the main casing 1152. A drive shaft fluid flow passage 1170 is disposed between the inner diameter ID of the main casing 1152 and the outer diameter OD of the drive shaft 1150. In some examples, the drive shaft fluid flow passage 1170 is an annular fluid flow passage between the drive shaft 1150 and the main casing 1152. The drive shaft fluid flow passage 1170 is in communication with a fluid flow path 103 of the drill string 102 at the uphole end 1138 of the drill head 1110. Further, due to the location of the drive coupling 1148 and the drive shaft 1150, the drive coupling 1148 and drive shaft 1150 are surrounded by fluid flow from the drive shaft fluid flow passage 1170. This allows drilling fluid to be in communication with the drive features 1168 of the drive shaft 1150 and the uphole end 1164 of the drive coupling 1148.

The flow collar 1151 is shown positioned around drive shaft 1150, adjacent the drive coupling 1148. In some examples, the main casing 1152 defines a recess 1155 in communication with the recess 1157 of the end casing 1144 when the end casing 1144 and the main casing 1152 are attached to one another. In some examples, the flow collar 1151 is positioned within the recess 1155 of the main casing 1152, around the drive shaft 1150. The flow collar 1151 aids in preventing axial movement of the drive coupling 1148 within the recess 1157 of the end casing 1144, yet also permits fluid flow from around the drive shaft 1150 to around the drive coupling 1148. The flow collar 1151 includes a plurality of peripheral fluid passages 1159 to allow fluid flow from the fluid flow path 103 around the drive shaft 1150 to an annular fluid flow passage 1153 defined between the flow collar 1151 and the recess 1155 and also between the recess 1157 and the drive coupling 1148. Therefore, fluid is not only allowed around the drive shaft 1150 within the drive coupling 1148 (i.e., coupling lubrication), but fluid flow is also facilitated by the flow collar 1151 to flow around the drive coupling 1148 within the recess 1157. In some examples, the flow collar 1151 is positioned within the recess 1157. In some examples, the flow collar 1151 is positioned to move freely within the recess 1155. In other examples, the flow collar 1151 is press fit into at least one of the recesses 1155, 1157.

Figure 13:
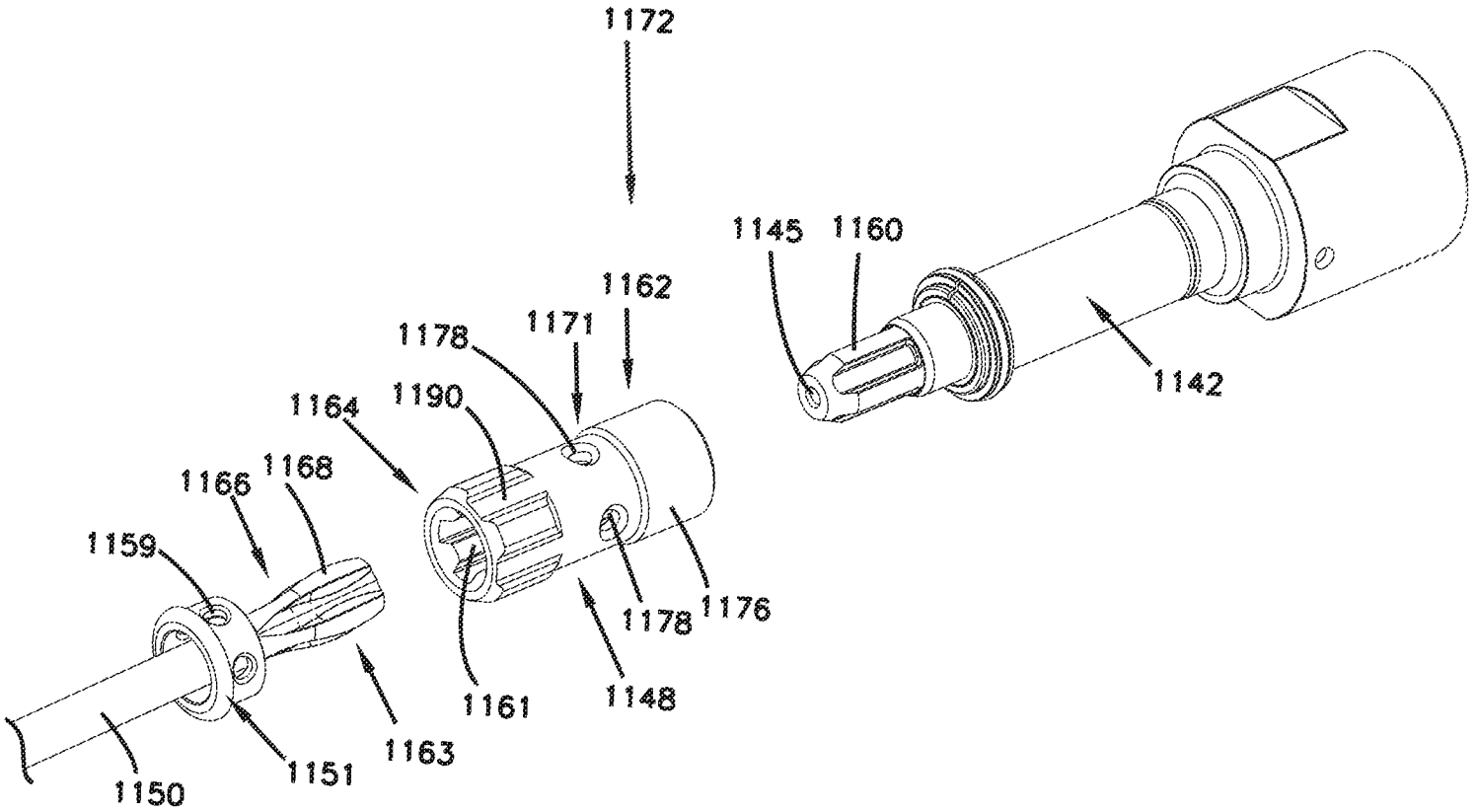
FIG. 13 illustrates a partially exploded view of a portion of the drill head of FIG. 12.

FIG. 13 shows a partial exploded view of an inner assembly 1172 of the drill head 1110 that includes the drive shaft 1150, the drive coupling 1148, the flow collar 1151, and the drill bit shaft 1142. The inner assembly 1172 is configured to drive the rotation of the drill bit 1140 via the inner drill rod 116 of the drill string 102. The drill bit shaft 1142 and the drive shaft 1150 are both straight members that are axially misaligned at the drive coupling 1148. In some examples, the misalignment of the drive shaft 1150 with the drive coupling 1148 is adjustable.

Figure 14:
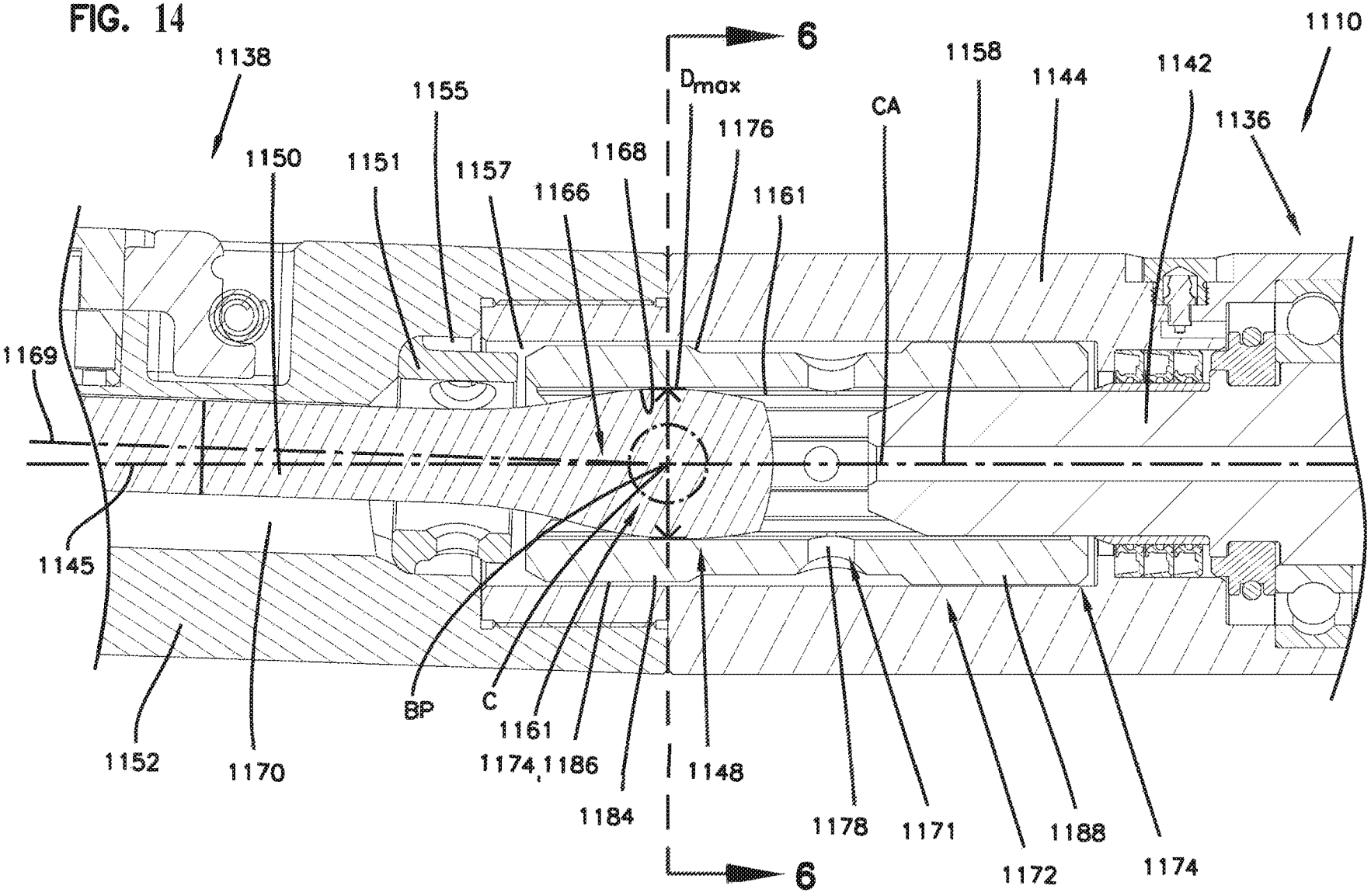
FIG. 14 illustrates a zoomed-in cross-sectional side view of the drill head of FIG. 12.

FIG. 14 shows a zoomed-in portion of the downhole end 1136 of the drill head 1110. In some examples, the drive coupling 1148 and/or the drive shaft 1150 can be assembled with one another to prevent decoupling from one another during a drilling operation. In some examples, the assembly can include press-fitting the drive coupling 1148 and drive shaft 1150 together. In some examples, the assembly to prevent decoupling can include heating at least one of the drive coupling 1148 and drive shaft 1150 prior to coupling. In some examples, the assembly to prevent decoupling can include providing a seam on the drive coupling 1148 (or the drive shaft 1150) to allow the drive coupling 1148 to be separated into multiple pieces. The multiple pieces can then be secured around the drive shaft 1150 by, for example, a fastener such as an adhesive, a bolt(s), a screw(s), a weld, or other type of fastener.

As shown and described above, because the end casing axis 1158 and the main casing axis 1169 are misaligned, they intersect at a balance point BP in the drill head 1110. The balance point BP is generally axially aligned with the connection point of the end casing and the main casing.

The downhole end 1166 of the drive shaft 1150 has an outer profile that is generally spherical and that defines a centroid C. The drive shaft 1150 is shown positioned within the central bore 1161 of the drive coupling 1148 so that the centroid C is aligned with a connection of the end casing 1144 and the main casing 1152. In some examples, the drive shaft 1150 has an outer profile that is generally an ellipsoid. In some examples, the drive shaft 1150 has an outer profile that is generally a prolate spheroid. The downhole end 1166 includes an enlarged portion 1163 that has a maximum diameter Dmax (also see FIG. 15.).

In the depicted embodiments, because the drive features 1168 of the drive shaft 1150 slide into the central bore 1161, the downhole end 1166 of the drive shaft 1150 is movable within the central bore 1161 of the coupling 1148 along a central bore axis CA. However, when the drive shaft axis 1167 is misaligned with the central bore axis CA, and therefore the end casing axis 1158, the drive shaft 1150 is positioned where the centroid C of the enlarged portion 163 of the drive shaft 1150 is coincident with the balance point BP. In some examples, the drive shaft 1150 is restrained from axial movement away from where the centroid C of the enlarged portion 163 of the drive shaft 1150 is coincident with the balance point BP. In some examples, the drive shaft 1150 and drive coupling 1148 are self-aligning and the centroid C is always urged toward coincident alignment with the balance point BP. In some examples, the drive shaft 1150 is restrained from moving downhole by the inner drill rod coupling 1119 interfacing with the outer rod adapter 1139. In some examples, the drive shaft 1150, specifically the enlarged portion 1163, after a brief run-in period, seats within the central bore 1161 of drive coupling 1148 so as to align the drive coupling 1148 and the drive shaft 1150 with one another.

Because the drive shaft 1150 is driven by the inner drill rod 116, the drive shaft 1150 can be affected by stack-up (i.e., longitudinal offset with respect to the inner drill rod 116 and the outer drill rod 114) within the drill string 102. However, due to the geometry and alignment of the components within the drill head 1110, the centroid C is always urged toward being in coincident alignment with the balance point BP of the drill head 1110. Such an alignment minimizes detrimental forces within the drill head 1110, thereby resulting in the drill head 1110 having a longer service life with less frequent service intervals.

For servicing, the user can access the drive coupling 1148 and downhole end 1166 of the drive shaft 1150 by uncoupling the end casing 1144 from the main casing 1152. During uncoupling, the bit shaft 1142 is slid from the central bore 1161 of the drive coupling 1148 because the central bore axis CA and the bit shaft axis 1156 are generally aligned with one another. After separation of the end casing 1144 from the main casing 1152, the downhole end 1136 of the drill head 1110, including at least the drive coupling 1148, can be aligned coaxially with the drive shaft 1150. Such alignment allows the separation of the drive shaft 1150 from the central bore 1161 of the drive coupling 1148. Such ease of access is advantages because the user is allowed quickly access the main torque transferring coupling (i.e., the connection between the drive shaft 1150 and the drive coupling 1148) of the drill head 1110 when separating only the main casing 1152 and the end casing 1144.

With continued reference to FIG. 14, the drive coupling 1148 is shown to include the central bore 1161, at least one coupling fluid flow passage 1171, and balancing features 1174 positioned on an exterior surface 1176.

The central bore 1161 is configured to be a through-bore within the drive coupling so that the central bore 1161 extends from the uphole end 1164 to the downhole end 1162. In some examples, the central bore 1161 has a consistent profile throughout. In some examples, the central bore can be formed in a way to ease manufacturing. In some examples broaching can be utilized to form the central bore 1161.

The coupling fluid flow passage 1171 can include a plurality of radial fluid flow passages 1178 extending between the exterior surface 1176 and the central bore 1161 (see FIG. 13). In some examples, the radial fluid flow passages 1178 are circumferentially positioned around the drive coupling 1148 to allow fluid from around the drive coupling 1148 to enter the central bore 1161. In some examples, the radial fluid flow passages 1178 are apertures such as holes, slots, or the like.

The exterior surface 1176 of the drive coupling 1148 includes portions that have different outer dimensions (e.g., outer diameters) to allow fluid flow around the drive coupling 1148 within the recess 1157 of the end casing 1144. Specifically, fluid flow is permitted around the exterior surface 1176 of the drive coupling 1148. Fluid travels in and out of the radial fluid flow passages 1178 so as to lubricate the central bore 1161 while also providing fluid flow to the inner fluid flow cavity 1145 of the drill bit shaft 1142. Therefore, portions 1190 of the exterior surface 1176 are dimensioned smaller than the recess 1157 of the end casing 1144 to allow fluid flow therebetween. However, alignment of the drive coupling 1148 within the recess 1157 is desired to reduce premature wear. In the depicted examples, to stabilize the drive coupling 1148 within the recess 1157, the drive coupling 1148 includes the balancing features 1174 disposed on the exterior surface 1176 that are configured to aid in stabilizing the drive coupling 1148 within the recess 1157 of the end casing 1144. Sufficient space is maintained between the recess 1157 and the drive coupling 1148, because, during a drilling operation, the drive shaft 1150 transfers rotation to the drill bit shaft 1142 through the drive coupling 1148, thereby rotating the drive coupling 1148. Because of this, at least at points during the drilling operation, the drive coupling 1148 rotates with the drive shaft 1150 within, and relative to, the recess 1157 in the end casing 1144.

The balancing features 1174 are dimensioned more closely to the dimension of the recess 1157, and larger than the portions 1190, to permit rotational movement between the drive coupling 1148 and the recess 1157, but limit substantial relative movement transverse to the end casing axis 1158 between the drive coupling 1148 and the recess 1157. In some examples, this aids in reducing movement (e.g., wobbling) of drive coupling 1148 generally perpendicular to the end casing axis 1158. Such movement can be caused by bending forces exerted on the drive coupling 1148 by the drive shaft 1150. By reducing relative movement of the drive coupling 1148 in the recess 1157, the loosening of the connection between the drive shaft 1150 and the central bore 1161 of the drive coupling 1148 is reduced, thereby limiting premature wear.

In some examples, the balancing features 1174 include uphole balancing features 1186 at the uphole end 1164 and downhole balancing features 1188 at the downhole end 1162 of the drive coupling 1148. However, because stabilizing and fluid flow is desired, especially around the uphole end 1164, the uphole balancing features 1186 include fluid flow passages 1190 (see FIG. 13) to allow fluid flow between the uphole end 1164 and the recess 1157 of the end casing 1144. The uphole balancing features 1186 are shown as generally rectangular projections. However, it is considered within the scope of the present disclosure that the uphole balancing features can be configured in a variety of different ways to achieve stabilization and allow fluid flow therethrough. For example, the uphole balancing features can be at least partially spherical. In other examples, the uphole balancing features 1186 can be secured to the exterior surface 1176 of the drive coupling 1148 by, for example, a fastener (e.g., bolt, adhesive, weld, etc.).

Figure 15:
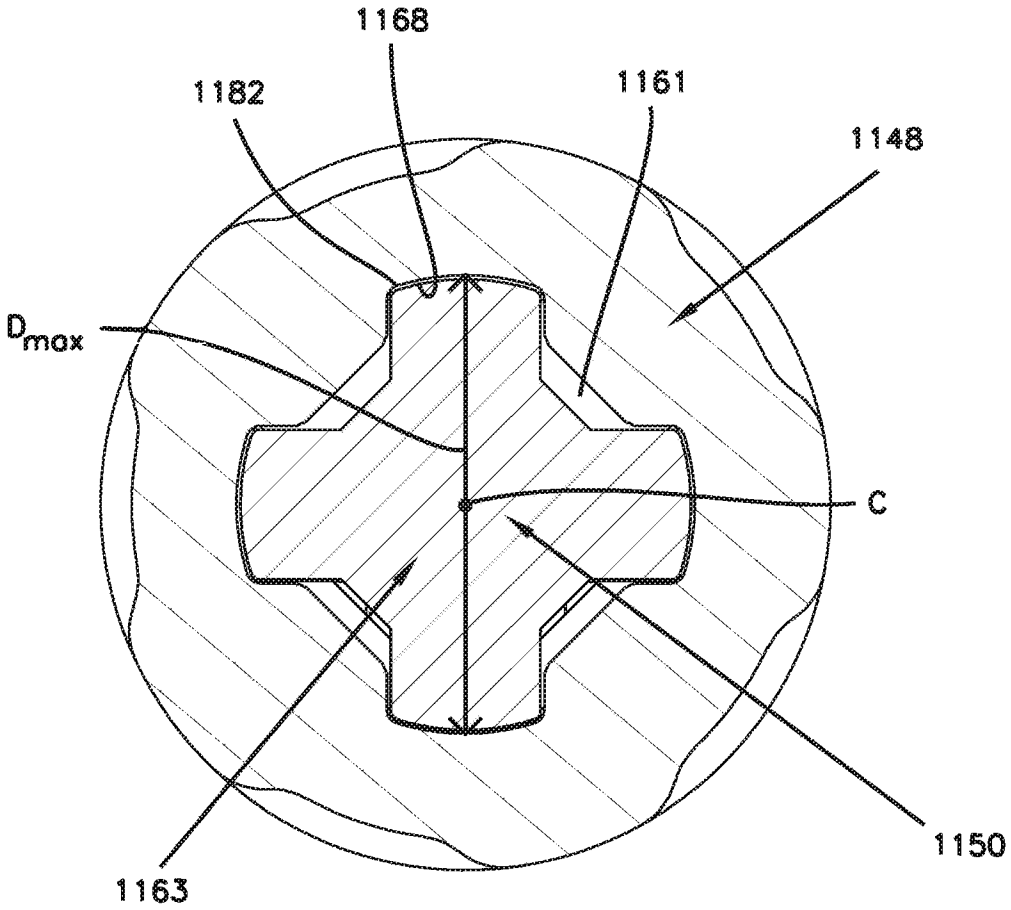
FIG. 15 illustrates a cross sectional view of a drive shaft and a drive coupling of the drill head along line 6-6 in FIG. 14.

FIG. 15 shows a cross sectional view of the drive coupling 1148 mated with the drive shaft 1150. As shown, the enlarged portion 1163 of the drive shaft 1150 has the maximum diameter Dmax and slides within the central bore 1161 of the drive coupling 1148. As shown, the drive features 1168 are received by similarly sized and shaped portions of the central bore 1161. In the depicted examples, the drive feature 1168 are received by corresponding recesses 1182 within the central bore 1161 so as to allow torque transfer between the drive coupling 1148 and the drive shaft 1150. As noted above, it is considered within the scope of the present disclosure that the drive shaft 1150 can have a variety of different cross-sectional shapes. Because the drive features 1168 make up generally spherical outer profiles of the downhole end 1166, the drive features 1168 of the drive shaft 1150 are at least curved along the drive shaft axis 1167. Such curvature allows the drive shaft 1150 to be misaligned with the central bore axis CA while still transferring torque and not binding or transferring large amounts of detrimental forces.

Figure 16:
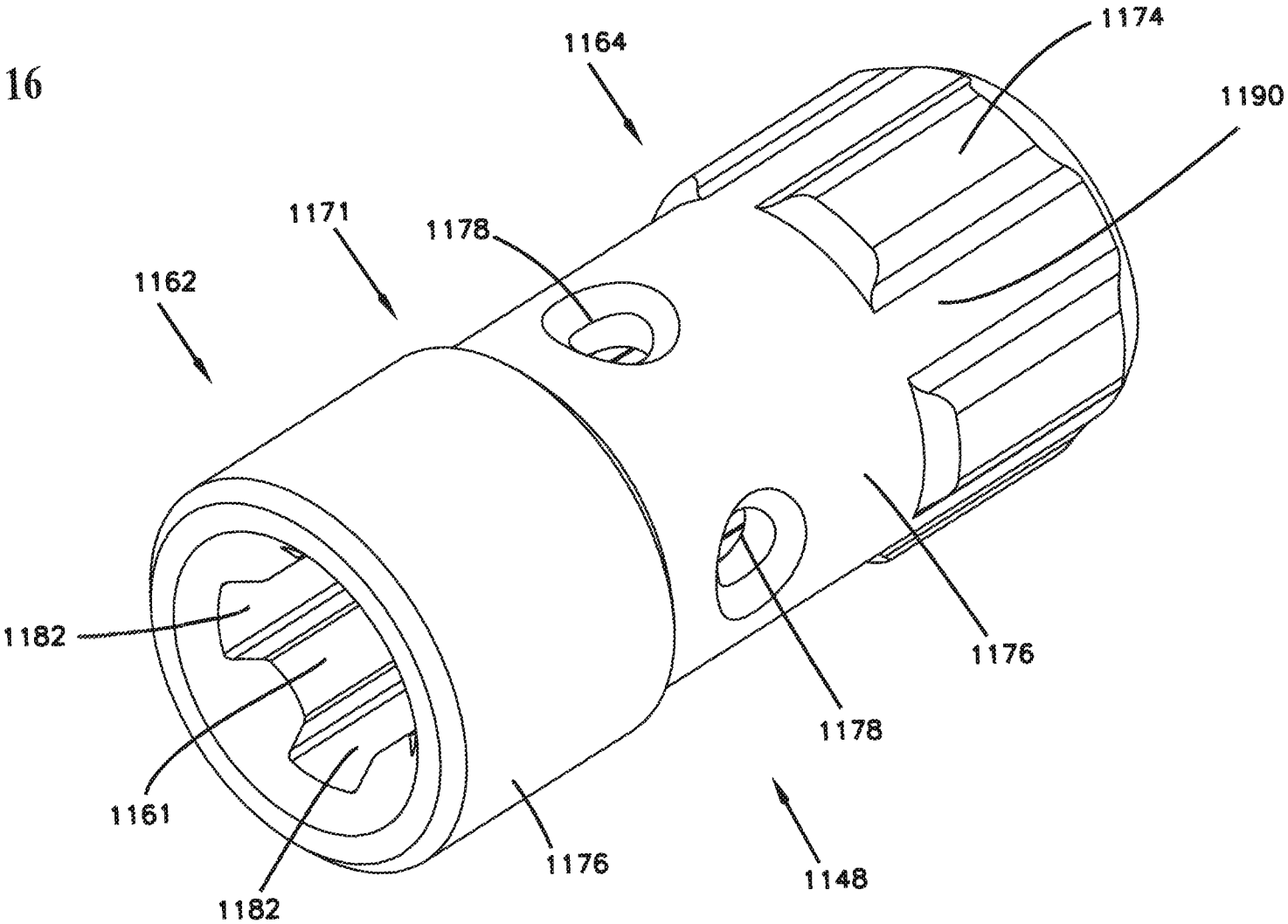
FIG. 16 illustrates a perspective view of a coupling according to one embodiment of the present disclosure.
Figure 18:
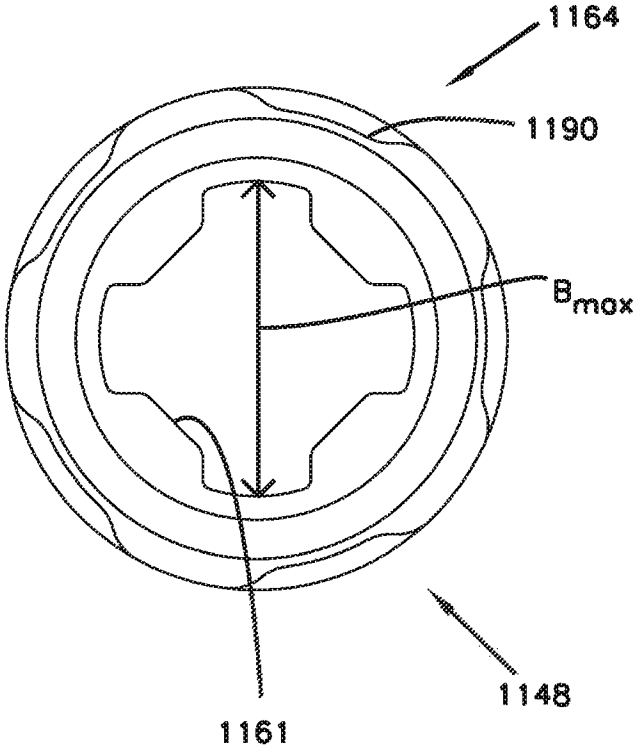
FIG. 18 illustrates another end view of the coupling of FIG. 16.
Figure 17:
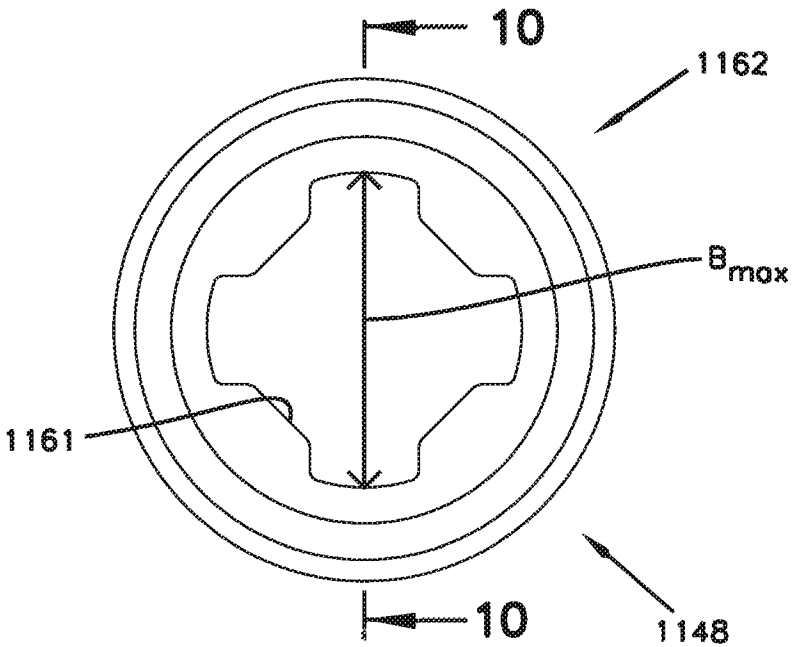
FIG. 17 illustrates an end view of the coupling of FIG. 16.

FIG. 16 shows a perspective view of the drive coupling 1148. FIGS. 17 and 18 shown opposing end views of the drive coupling 1148. As noted above, the central bore 1161 is a through bore. In the depicted example, the central bore 161 has a consistent maximum diameter Bmax from the uphole end 1164 to the downhole end 1162 of the coupling 1148.

Figure 19:
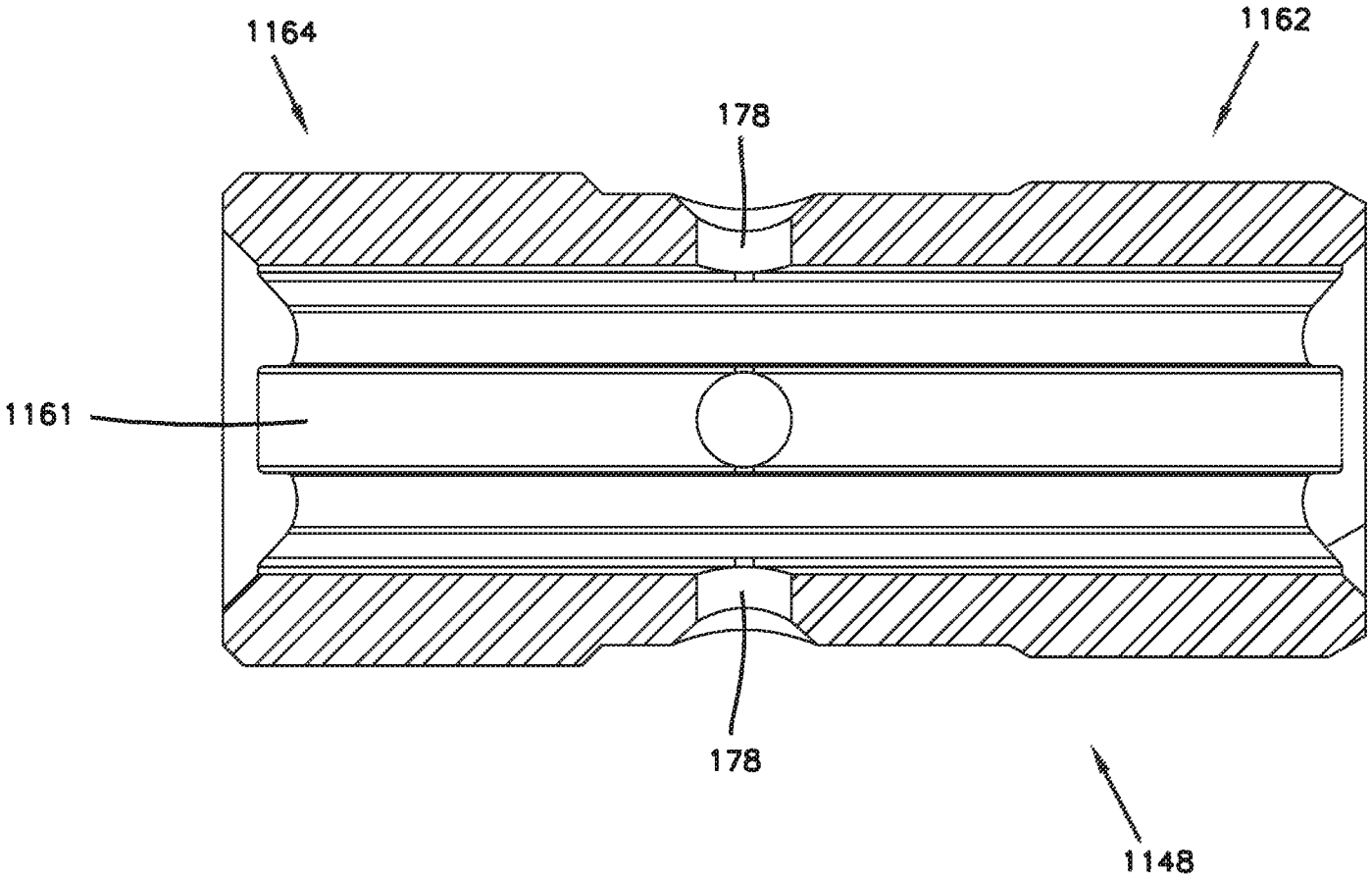
FIG. 19 illustrates a longitudinal cross sectional view of the coupling of FIG. 16.

FIG. 19 shows a longitudinal cross sectional view of the drive coupling 1148. As shown, the central bore 1161 is consistent from the uphole end 1164 to the downhole end 1162. In the depicted embodiments, the central bore 1161 is free from additional features that would impede: 1) the movement of the drive shaft 1150 (and to an extent the drill bit shaft 1142); and 2) fluid flow within the central bore 1161.

Figure 21:
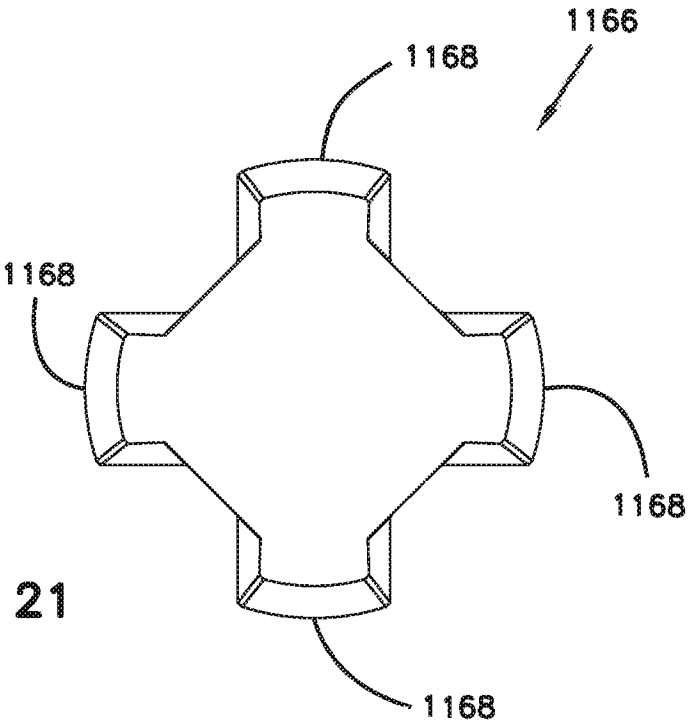
FIG. 21 illustrates an end view of the downhole end of the drive shaft of FIG. 20.
Figure 20:
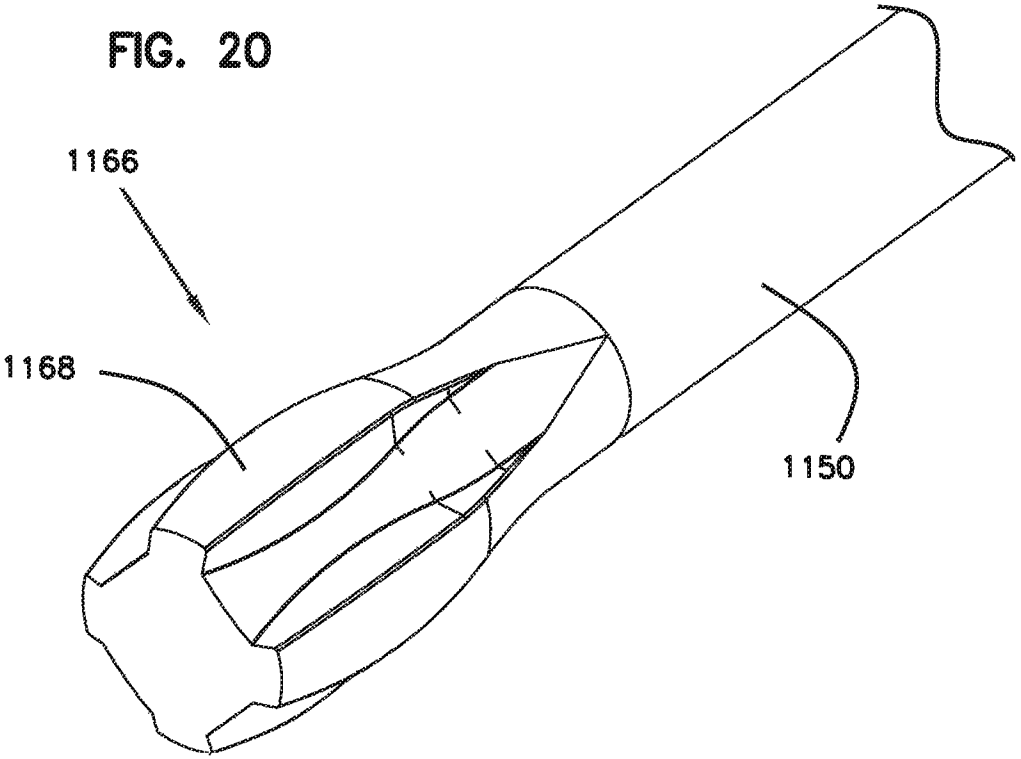
FIG. 20 illustrates a perspective view of a downhole end of a drive shaft according to one embodiment of the present disclosure.

FIG. 20 shows a perspective view of the downhole end 1166 of the drive shaft 1150, and FIG. 21 shows an end view of the downhole end 1166 of the drive shaft 1150.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A drill head configured for horizontal directional drilling, the drill head comprising:

an uphole portion comprising:

a main casing with a main casing axis and an inner diameter;

a drive shaft having a downhole end that includes an enlarged portion having drive features that are torque transmitting and radial load bearing, the drive shaft having a drive shaft axis and an outer diameter, wherein the drive shaft axis is aligned with the main casing axis, wherein the enlarged portion has a maximum diameter and a generally spherical shape that defines a centroid; and a drive shaft fluid flow passage between the inner diameter of the main casing and the outer diameter of the drive shaft;

a downhole portion comprising:

an end casing connected to the main casing, the end casing having an end casing axis that is misaligned with the main casing axis, wherein the end casing axis and the main casing axis intersect at a balance point of the drill head; and a drill bit shaft having a drill bit shaft axis and an inner fluid flow cavity, the drill bit shaft having an uphole end that includes drive features that are torque transmitting and radial load bearing, wherein the drill bit shaft axis is not aligned with the drive shaft axis; and a drive coupling having an uphole end and a downhole end, wherein the drive coupling includes a central through bore having a central bore axis, the central through bore including drive features disposed within the central through bore, wherein the drive features at the uphole end of the drive coupling receive the drive features of the drive shaft, and wherein the drive features at the downhole end of the drive coupling receive the drive features of the drill bit shaft, wherein the drive coupling is configured to transfer rotation between the drive shaft and the drill bit shaft, wherein the drive coupling further includes at least one radial fluid flow passage, wherein the drive shaft fluid flow passage, the central through bore of the drive coupling, the at least one radial fluid flow passage of the drive coupling, and the inner fluid flow cavity of the drill bit shaft are in fluid communication, and wherein the downhole end of the drive shaft is movable within the central through bore of the drive coupling along the central bore axis, wherein the drive shaft is positioned where the centroid of the enlarged portion of the drive shaft is coincident with the balance point of the drill head.

2. The drill head of claim 1, wherein fluid flow is permitted between the uphole and downhole ends of the central through bore of the drive coupling.

3. The drill head of claim 1, wherein the drive coupling includes balancing features disposed at an exterior surface of the drive coupling at the uphole end.

4. The drill head of claim 3, wherein the drive coupling is positioned within a recess of an end casing, the balancing features being configured to permit rotation of the drive coupling with respect to the recess and to limit drive coupling movement transverse to an end casing longitudinal axis, wherein the balancing features include at least one fluid flow passage generally parallel to the end casing longitudinal axis.

5. The drill head of claim 1, wherein the main casing includes a sonde housing for receiving a sonde therein.

6. The drill head of claim 1, wherein the drive coupling is at least partially positioned within a recess of the end casing.

7. The drill head of claim 1, further comprising a flow collar positioned around the drive shaft and adjacent the drive coupling, wherein the flow collar includes at least one peripheral fluid flow passage that permits fluid flow between an uphole end portion and a downhole end portion of a drill head arrangement.

8. The drill head of claim 1, wherein the drive coupling includes balancing features disposed at an exterior surface of the drive coupling at the uphole end, wherein the drive coupling further includes a plurality of radial fluid flow passages positioned between the balancing features and the downhole end of the drive coupling.

9. The drill head of claim 1, wherein the central through bore of the drive coupling has a consistent maximum diameter from the uphole end to the downhole end.

10. The drill head of claim 1, wherein the drill head is attached to a drill string, and wherein the drill string is attached to a horizontal directional drilling machine.

11. The drill head of claim 10, wherein the drill string includes an inner and an outer drill rod assembly.

12. The drill head of claim 11, wherein the drive shaft is rotationally driven by the inner drill rod assembly, and wherein the inner drill rod assembly is rotationally driven by a gearbox of the horizontal directional drilling machine.

13. A method of aligning a drive shaft within a drive coupling in a horizontal directional drilling drill head, the method comprising:

providing a main casing with a main casing axis and an inner diameter;

providing a drive shaft positioned at least partially within the main casing, the drive shaft having a downhole end that includes an enlarged portion having drive features that are torque transmitting and radial load bearing, the drive shaft having a drive shaft axis and an outer diameter, wherein the enlarged portion has a maximum diameter and a generally spherical shape that defines a centroid;

providing an end casing connected to the main casing, the end casing having an end casing axis that is misaligned with the main casing axis, wherein the end casing axis and the main casing axis intersect at a balance point of the drill head; and providing a drive coupling positioned within the end casing, the drive coupling having an uphole end and a downhole end, wherein the drive coupling includes a central through bore having a central bore axis, the central through bore including drive features disposed within the central through bore, wherein the drive features at the uphole end of the drive coupling receive the drive features of the drive shaft, wherein the downhole end of the drive shaft is movable within the central through bore of the drive coupling along the central bore axis; and aligning the centroid of the enlarged portion of the drive shaft to be coincident with the balance point of the drill head.

14. The method of claim 13, further comprising providing a drive shaft fluid flow passage between the inner diameter of the main casing and the outer diameter of the drive shaft.

15. The method of claim 13, further comprising providing a drill bit shaft having a drill bit shaft axis and an inner fluid flow cavity, the drill bit shaft having an uphole end that includes drive features that are torque transmitting and radial load bearing, wherein the drill bit shaft axis is not aligned with the drive shaft axis, and wherein the drive features at the downhole end of the drive coupling receive the drive features of the drill bit shaft.

16. The method of claim 15, further comprising providing fluid flow to the inner fluid flow cavity of the drill bit shaft through the central through bore of the drive coupling.

17. The method of claim 16, further comprising providing at least one radial fluid flow passage in the drive coupling.

18. The method of claim 17, further comprising providing fluid flow between the central through bore of the drive coupling, the at least one radial fluid flow passage of the drive coupling, and the inner fluid flow cavity of the drill bit shaft.

19. The method of claim 18, wherein the central through bore of the drive coupling has a consistent maximum diameter from the uphole end to the downhole end of the drive coupling.

* * * * *